US005603614A

United States Patent [19]

Sakata et al.

[11] Patent Number: 5,603,614

[45] Date of Patent: Feb. 18, 1997

[54] FLUID COMPRESSING DEVICE HAVING COAXIAL SPIRAL MEMBERS

[75] Inventors: Hirotsugu Sakata; Masayuki Okuda, both of Kanagawa-ken, Japan

[73] Assignee: Kabushiki Kaisha Toshiba, Kawasaki, Japan

[21] Appl. No.: 530,604

[22] Filed: Sep. 20, 1995

[30] Foreign Application Priority Data

Sep. 30, 1994 [JP] Japan ..... 6-261000

[51] Int. Cl.[6] ..... F01C 1/04

[52] U.S. Cl. ..... 418/55.2; 418/55.4

[58] Field of Search ..... 418/55.2, 55.4, 418/150

[56] References Cited

U.S. PATENT DOCUMENTS 4,732,550 3/1988 Suzuki et al. ..... 468/55.4
4,969,810 11/1990 Stolle et al. ..... 418/55.4

FOREIGN PATENT DOCUMENTS 4121483 4/1992 Japan ..... 418/55.2
5071477 3/1993 Japan ..... 418/55.2

*Primary Examiner*—Charles G. Freay
*Attorney, Agent, or Firm*—Foley & Lardner

[57] ABSTRACT

A fluid machine for transferring working fluid has fixed and rotating spiral members. The fixed spiral member has a stepped internal engagement surface that spirally rises upwardly and inwardly toward its center. The rotating spiral member revolves relative to the fixed spiral member and also has a stepped outer engagement surface that spirally rises upwardly inwardly toward its center. The stepped internal engagement surface of the fixed spiral member engages the stepped outer engagement surface of the rotating spiral member, which together form a compression mechanism. A working space is formed between the engagement surfaces of the spiral members. The capacity of the working space gradually decreases toward the center from the largest to the smallest circumference. A seal member is positioned between the stepped surfaces of the spiral members to seal the working space.

27 Claims, 23 Drawing Sheets

0°

90°

180°

270°

FLUID COMPRESSING DEVICE HAVING COAXIAL SPIRAL MEMBERS

BACKGROUND OF THE INVENTION

1. Technical Field

The present invention relates to a fluid machine for transferring working fluid suitable for use with a compressor, expansion machine or pump.

2. Background Art

Conventionally, as a representative of a fluid machine in terms of a compressor, there is available a scroll compressor.

Describing a brief configuration of the scroll compressor, a spiral member at a fixed scroll side and a spiral member at a revolving scroll side are engaged to each other so as to produce a revolving motion in the revolving scroll; as a result thereof, a compression space is formed, which accompanies a gradual decrease of capacity toward a center from a circumference thereof, and the compressed working fluid is discharged from a discharge port provided in a core side.

In the scroll compressor, the fluid is compressed radially from an outside toward the core side, and the radius of the revolving scroll determines a compression volume. Therefore, an entire device is large-sized as the compression volume is increased. Moreover, in each spiral member, an inside and outside thereof become an outer engaging surface and inner engaging surface, respectively. Thus, the outer engaging surface and inner engaging surface in each spiral member must be processed with accuracy. In this connection, the conventional compressor is not desirable in terms of the accurate processing requirement and sealing capability that may involve a possible seal leakage.

SUMMARY OF THE INVENTION

In view of the foregoing drawbacks, it is therefore an object of the present invention to provide a fluid machine suitable for use with a compressor, expansion machine or pump, equipped with a working space that forms a sealed space having a high compressibility and expansion coefficient. There is provided the fluid machine, if utilized as the compressor, which does not become large-sized, which realizes an increase in compression capacity and an improvement in compression efficiency, and which is desirable in terms of processing thereof.

Another object of the present invention is to provide a fluid machine that does not become large-sized, realizes an increase of the compression capacity, suppresses the seal leakage leakage, and which is very desirable in terms of processing thereof.

Firstly, the fluid machine according to a preferable embodiment, comprises: a first spiral including a cross-section step-formed inner engagement surface that spirally rises up from an outer circumference toward a center; a second spiral that performs a revolving motion relative to the first spiral, including a spiral-shaped outer engagement surface that is cross-section step-formed; and a working mechanism portion engaged with the inner engagement surface of the first spiral and the outer engagement surface of the second spiral that forms a sealed space where a capacity thereof is gradually decreased toward the center from the outer circumference.

Moreover, in the above fluid machine, the first spiral performs an eccentric motion and includes a plurality of sliding portions in an eccentric direction in between the second spiral, so as to form a plurality of 360-degree sealed spaces in three dimensional directions.

Moreover, there is provided a compression mechanism portion that is engaged with a step surface of the inner engagement surface in the first spiral side and the outer engagement surface of the second spiral where a capacity thereof is gradually decreased toward the center from the outer circumference, thereby forming a compressor space. There is provided a seal member between the step surface of the inner engagement surface in the first spiral side and the step surface of the outer engagement surface in the first spiral side, so as to seal the compressor space. According to the above fluid machine, the rotation power is transmitted to the main shaft by a drive motor, and thereby the revolving spiral produces the revolving motion. Then, the working gas taken in from the outer circumference by the compressor space where the volume thereof is gradually decreasing, rises up toward the center and is compressed then discharged. In this case, the compression volume is determined by the radial direction and height direction, and high compressibility can be obtained.

Moreover, the load point during operation acts on the central position of an eccentric shaft portion in the main shaft, so that the upsetting moment of the revolving spiral can be suppressed to its minimum and a stable and efficient compression state can be obtained.

Secondly, there is provided the fluid machine that comprises: a revolving spiral that can produce revolving motion, including a cross-section step-formed inner engagement surface which spirally rises up from an outer circumference toward a center; a compression mechanism portion engaged with the inner engagement surface of the revolving spiral that forms a compressor space where a capacity thereof is gradually decreased toward the center from the outer circumference, and which is comprised of a fixed spiral that includes a spiral-shaped outer engagement surface formed in a cross-section step-formed manner; and a seal member provided between a step surface of the inner engagement surface at a side of the revolving spiral and a step surface of the outer engagement surface at a side of the fixed spiral, so as to seal the compressor space.

According to another preferable embodiment of the present invention, an eccentric shaft portion of the main shaft producing the revolving motion is freely rotatably inserted into the revolving spiral, so as to realize a configuration where the drive motor is transmission-connected to the main shaft.

Moreover, the drive motor and the compression mechanism portion in the fluid machine according to the above invention, may be configured such that the compression mechanism portion is above or below the drive motor. Or, an entire fluid machine may be covered with a sealed case so that suction gas or discharge gas is filled in the sealed case.

Moreover, in the fluid machine according to the present invention, a bearing portion of the revolving spiral may be inserted to the eccentric shaft portion of the main shaft so that the load point that acts upon the revolving spiral coincides with the central portion of the eccentric shaft portion.

In the above fluid machine according to the present invention, the spiral shape for the first spiral and second spiral is of an open curve such that it is comprised of spirals having a plurality of tangent points only in the eccentric direction if the engagement of the first and second spiral is viewed in the plane. That is, the spiral shape for the first and second spirals is formed by an involute spiral, Archimedes spiral or logarithmic spiral.

Moreover, in the spiral shape for the first and second spirals is such that the axial height of the spiral is increased at a given rate toward the direction where the radius is less.

Moreover, in the fluid machine according to the present invention, the radial height for the step-formed portion of the first spiral is constant on the radius from the spiral's center or on a basic circle's tangent line about the spiral (in the case of circle's involute utilized). The radial height may be of a sloped type. For example, the outside is lowered and a chip seal therefor is slanted, so that the durability is improved.

Moreover, in the fluid machine according to the present invention, the spiral shape for the first and second spirals is such that there is provided a step difference so that the axial height of the spirals is spirally increased. Thereby, the axial height of the first and second spirals is continuously increased.

Moreover, in the fluid machine according to the present invention, the height of the first and second spirals is varied according to the position of the spirals.

Moreover, according to still another preferable embodiment of the present invention, the fluid machine comprises: a first spiral including a cross-section step-formed inner engagement surface spirally rising up from an outer circumference toward a center; a second spiral that performs a revolving motion relative to the first spiral, including a spiral-shaped outer engagement surface that is cross-section step-formed; a compression mechanism portion engaged with the inner engagement surface of the first spiral and the outer engagement surface of the second spiral and which forms a compressor space where a capacity thereof is gradually decreased toward the center from the outer circumference; and a seal member provided in a spiral continuous closed space, the spiral closed space being formed between a step surface of the inner engagement surface at a side of first spiral and a step surface of the outer engagement surface at a side of the second spiral, wherein the width of the seal member is greater than a high-low variable width of the spiral caused by the revolving motion by which each spiral revolves relative to other.

Moreover, in the fluid machine according to still another embodiment of the present invention, there is formed a spirally continuous closed space between a step surface of the inner engagement surface of the first spiral side and a step surface of the outer engagement surface of the second spiral side. There is provided a seal member within the closed space and a sub-seal portion is integrally provided with the seal member, which reduces an invasion area through which gas enters to the closed space.

Moreover, in the fluid machine according to still another embodiment of the present invention, there is formed a spirally continuous closed space between a step surface of the inner engagement surface of the first spiral side and a step surface of the outer engagement surface of the second spiral side. There is provided a seal member within the closed space so as to partition into small closed spaces.

Moreover, in the fluid machine according to still another embodiment of the present invention, there is formed a spirally continuous closed space between a step surface of the inner engagement surface of the first spiral side and a step surface of the outer engagement surface of the second spiral side. There is provided a seal support ditch at a side of the engagement-surface step surface serving as a fixed side that forms the closed space, there is provided a seal member in the seal support ditch so as to partition into small closed spaces, wherein the seal's upper surface of the seal member and the ditch surface of the seal support ditch disposed counter to the seal upper surface are of the identical contact-surface shape so as to be capable of being contacted to each other.

The seal's upper surface is of the same shape as the cutting-processing surface obtained when the seal support ditch is cut-processed (which is the similar applied to other case than the ditch).

According to the above-described fluid machine according to the present invention, the first spiral and the second spiral revolve relative to each other while the outer engagement surface is engaged with the inner engagement surface. Thus, there is formed the compressor space in which a capacity thereof is gradually decreased toward the center. Thereby, the working gas taken in by the compressor space from outside is compressed and then discharged while it is rising upward the center.

In this case, a compressed volume in the compressor space is determined from the axial direction and height direction, there can be obtained a large amount of compression volume without making a whole machine larger-sized. On the other hand, the closed space between the compressor spaces is partitioned to have small spaces by the seal member, so that the seal leakage can be suppressed maximally even if it happens, thus realizing efficient compression.

BRIEF DESCRIPTION OF THE DRAWINGS

These and other objects, features and advantages of the present invention will become more apparent from the following description of the preferred embodiment taken in conjunction with the accompanying drawings, in which.

DETAILED DESCRIPTION OF THE PREFERRED EMBODIMENTS

Features of the present invention will become apparent in the course of the following description of exemplary embodiments given for illustration of the invention and are not intended to be limiting thereof. Embodiments of the present invention will now be described with reference to the drawings.

First, referring to FIGS. 1–7, an embodiment for the present invention will be described in detail.

A fluid machine according to the present invention can be utilized, in terms of its structure, as a compressor, expansion machine or pump. In order to explain structure and operation thereof in this specification, the compressor is taken as its representative and will be explained in detail hereinbelow. However, notice that the present invention is not limited to the compressor alone.

Figure 1:
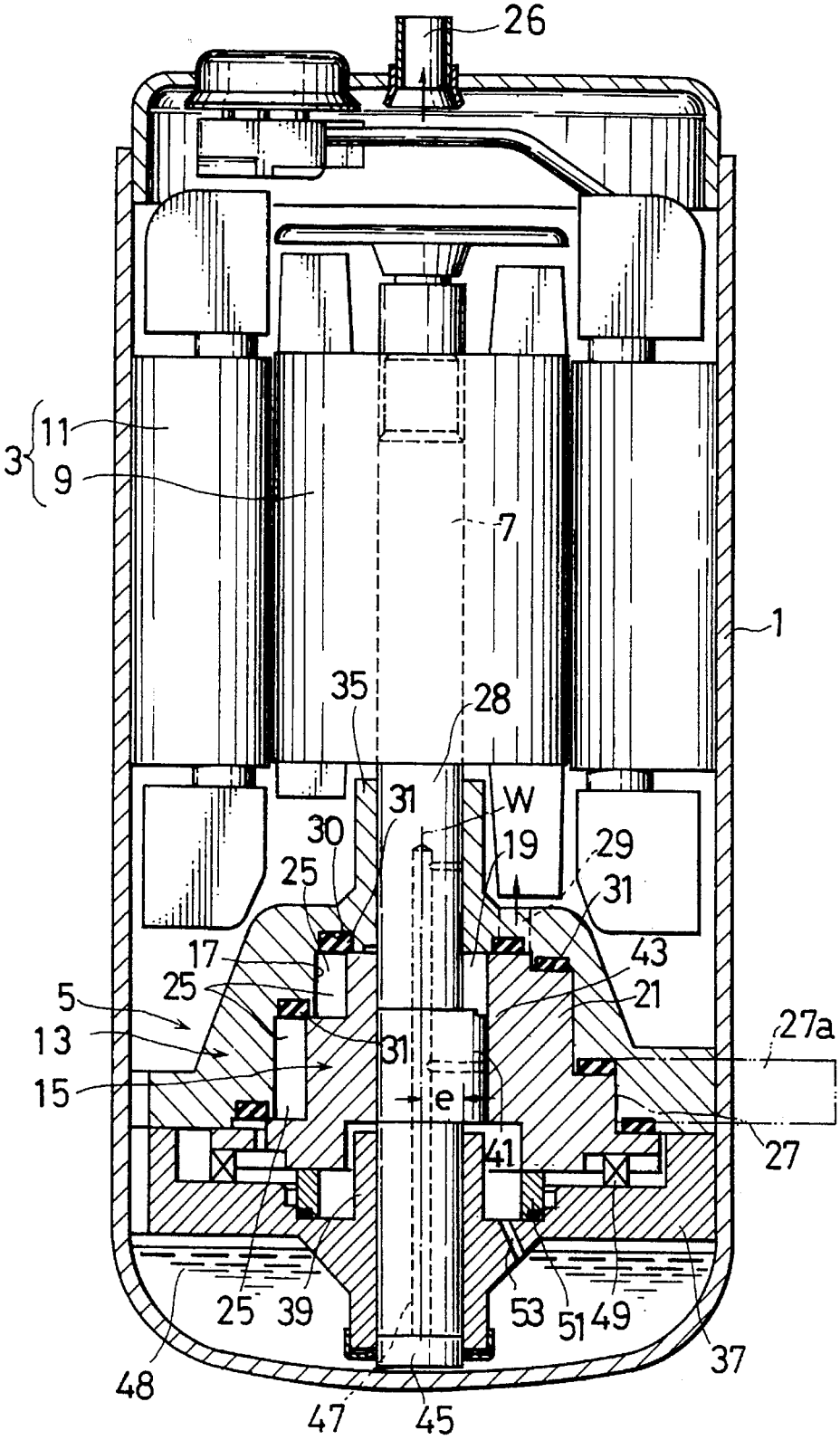
FIG. 1 is a cross sectional view of an entire fluid machine according to the present invention.

FIG. 1 is a cross sectional view of the fluid machine according to the present invention. In FIG. 1, the reference numeral 1 denotes a sealed casing. There are provided a drive motor 3 and an operation mechanism portion 5 within the sealed casing 1, where the operation mechanism portion 5 will serve as a compression mechanism portion 5 in the case of the compressor.

The drive motor 3 includes a rotor 9 fixed to a main shaft 7, and a stator 11 fixed and supported in an inner wall of the sealed casing 1. When electric current flows through the stator 11, rotation power is generated to the main shaft 7 via the rotor 9.

Figure 2:
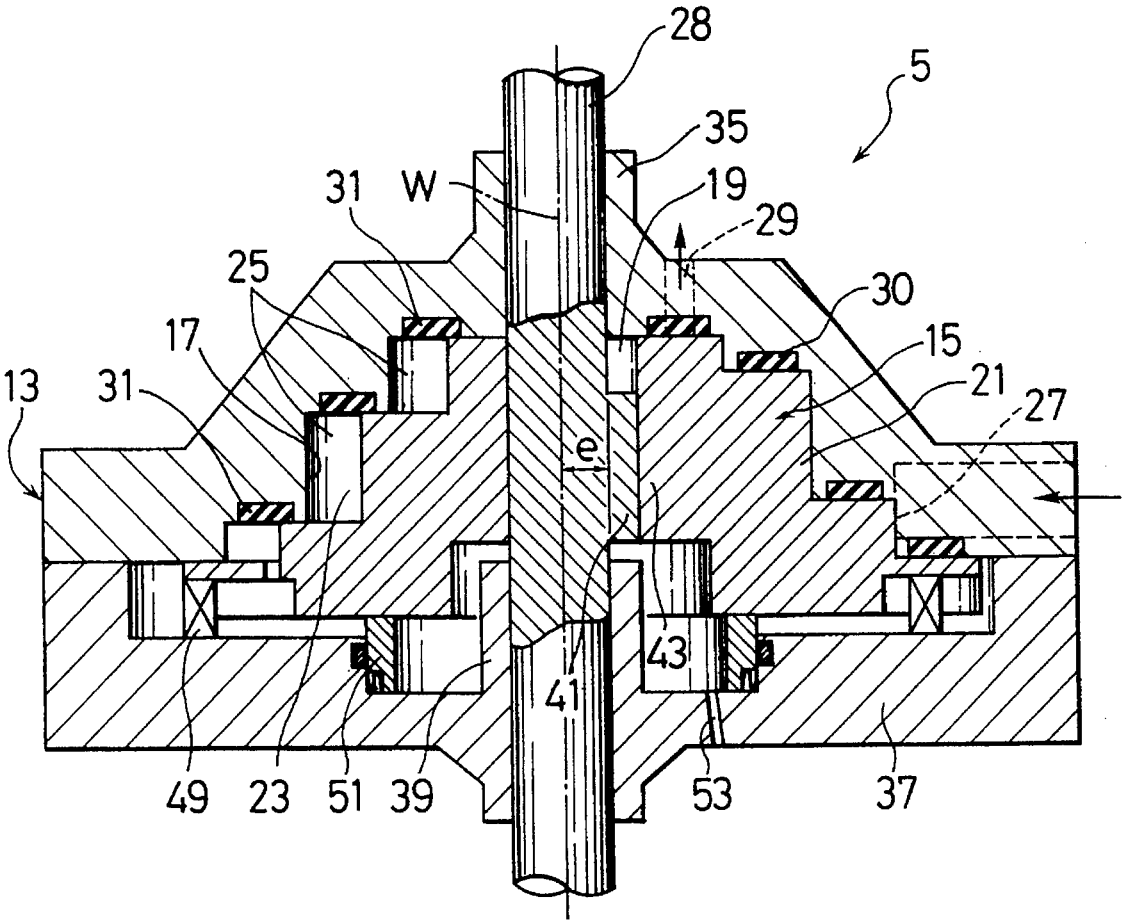
FIG. 2 shows a cross section of a compressor mechanism which constitutes the fluid machine shown in FIG. 1.

FIG. 2 is a cross sectional view of the compression mechanism portion 5, which is a constituting element of the fluid machine shown in FIG. 1.

Figure 3:
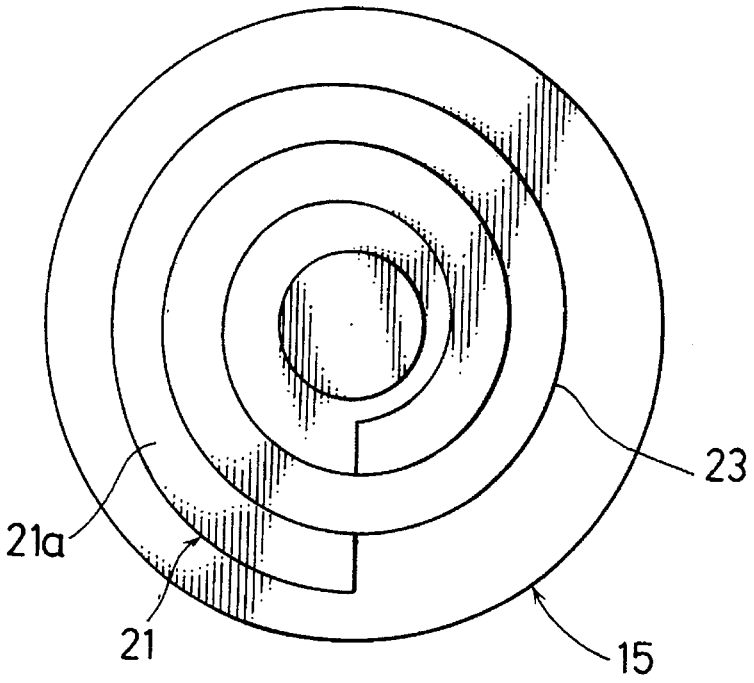
FIG. 3 is a plan view showing a revolving spiral that constitutes the fluid machine shown in FIG. 1.

FIG. 3 is a plan view of a revolving spiral 15 which is a constituting element of the fluid machine shown in FIG. 1.

In FIG. 2, the compression mechanism portion 5 serving as the operation mechanism portion, comprises a fixed spiral 13 and a revolving spiral 15 through which the main shaft 28 (which will be described in detail later) is penetrated.

In the fixed spiral 13, there are formed a spiral-stepped spiral space 19 where the radius of the spiral-shaped internal engagement surface 17 decreases gradually from the outer circumference toward a center thereof and they are fixed and supported in the inner wall of the sealed case 1.

With reference to FIG. 3, the revolving spiral includes a spiral body where it rises up outwardly and in the form of spiral steps from the outer circumference to the center, and the radius thereof decreases gradually, and the outer circumference of the spiral body 21 becomes an inner engagement surface 23.

Figure 4:
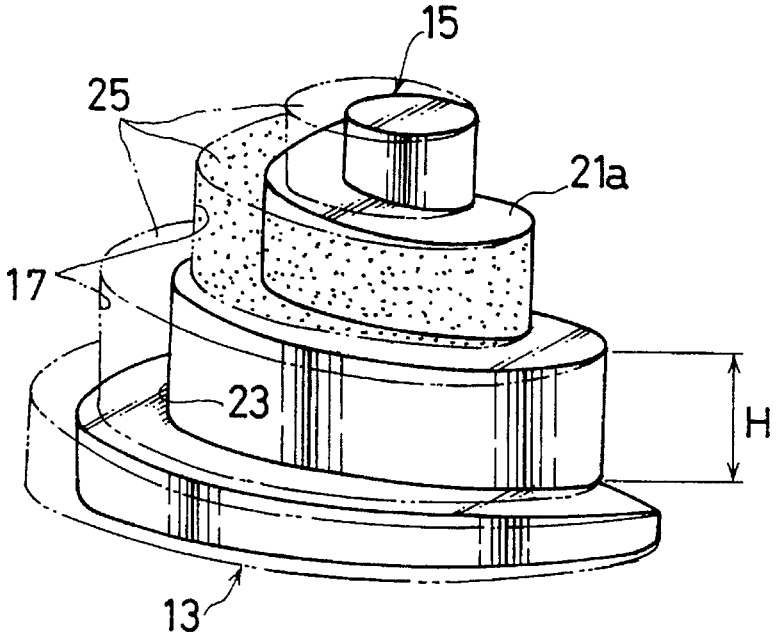
FIG. 4 illustrates how a fixed spiral and a revolving spiral are engaged to each other in the fluid machine shown in FIG. 1.

FIG. 4 illustrates how the fixed spiral is engaged with the revolving spiral in the fluid machine shown in FIG. 1. As shown in FIG. 4, the inner engagement surface 23 of the spiral body 21 is engaged with an outer engagement surface 17 at a side of the fixed spiral 13. Thereby, a working space 25 is formed, or there is formed a compressor space 25 if the fluid machine is utilized as a compressor.

Figure 5A:
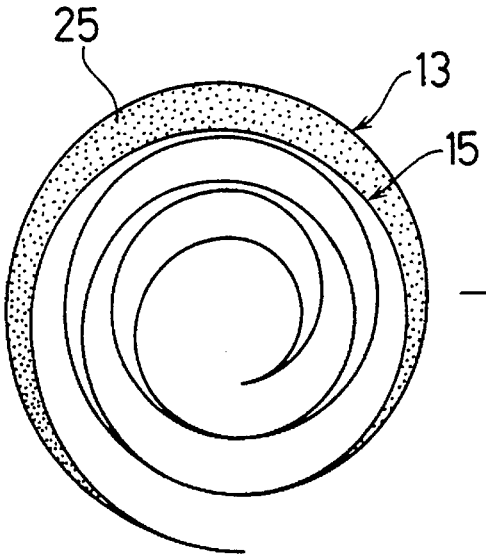
FIG. 5A through 5D illustrate compressing processes in a compressor mechanism.

FIG. 5A shows a compression process at which the revolving spiral 15 is started to revolve (indicated by 0° of revolving rotation).

Figure 5B:
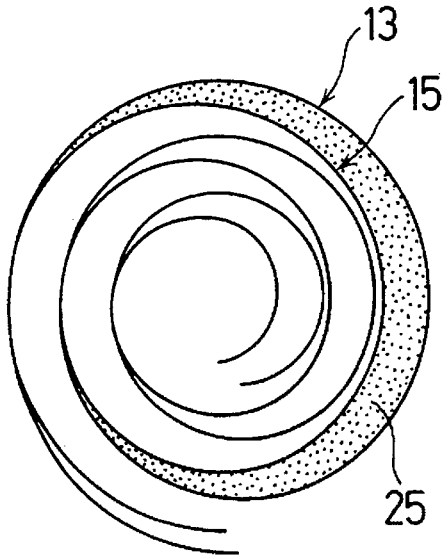

FIG. 5B shows a compression process at which the revolving spiral 15 is rotated by 90° from a starting point.

Figure 5C:
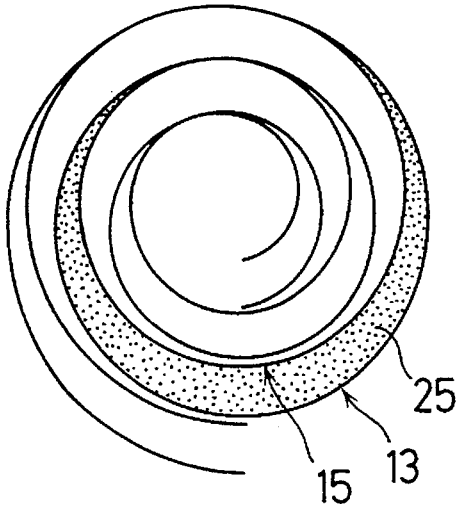

FIG. 5C shows a compression process at which the revolving spiral 15 is rotated by 180° from the starting point.

Figure 5D:
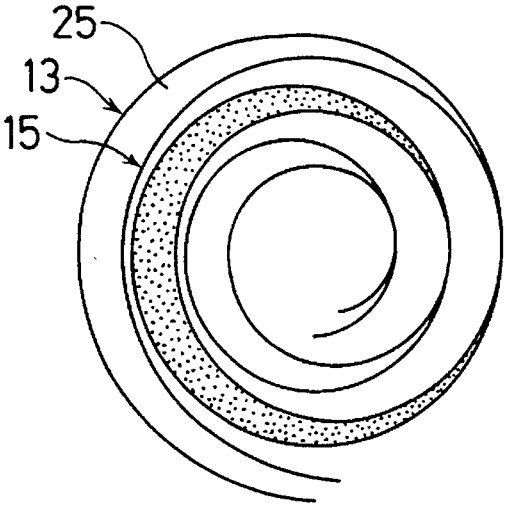

FIG. 5D shows a compression process at which the revolving spiral 15 is rotated by 270° from the starting point.

As shown in FIG. 1, the compressor space 25 serving as the working space 25 is respectively connected to the suction port 27 directly connected to suction pipe 27*a* extended externally of the sealed casing 1. A discharge pipe 26 is provided in an upper portion of the sealed casing 1 and a discharge port 29 is framed in the inner space inside the sealed casing 1. Thereby, the revolving motion is generated to the revolving spiral 15, so that the working gas from the suction port 27 is moved toward the center and discharged finally from the discharge port 29 accompanied by the decrease of volume thereof, as shown in FIG. 5A–FIG. 5D.

In this case, it is preferable that there is provided a check valve (not shown) in the suction port 27 or discharge port 29. Thereby, counterflow of gas in the event of reverse rotation stoppage can be prevented.

Moreover, as another advantageous aspect, the discharge port 29 is closely located to an edge of the rotor 9, so that the rotation of rotor 9 makes possible that oil in gas discharged from the discharge port 29 can be separated.

In the compressor space 25, the compression volume is determined by a pitch of the spiral (denoted by H) in addition to the radial direction, and there is a seal by the seal provided member 31. The seal member 31 is freely movably fit in the ditch 30, which is continuously and spirally formed in the step-surface of the outer engagement surface 17 lying at the side of the fixed spiral 13, and is elastically connected with the upper surface 21*a* of spiral body 21 in the revolving spiral 15.

The main shaft 28 serving as a working mechanism portion, which penetrates the compression mechanism portion 5, is formed integrally and continuously with the main shaft 7 of the drive motor 3. Both ends of the main shaft are freely rotatably supported by a main bearing 35 of the fixed spiral 13 and a secondary bearing 39 of a support frame 37 fixed and supported inside an inner wall surface of the sealed casing 1.

In the main shaft 28, there is provided an eccentric shaft portion 41, which is eccentric against a central shaft center W. In the eccentric shaft portion 41, a bearing portion 43 of the revolving spiral 15 is freely rotatably mounted. Through a lubricating passage 47, lubricating oil is fed to the bearing portion 43 of the revolving spiral 15, the main bearing 35 and the secondary bearing 39 by an oil pump 45 provided at a lower end of the main shaft 28.

Figure 6:
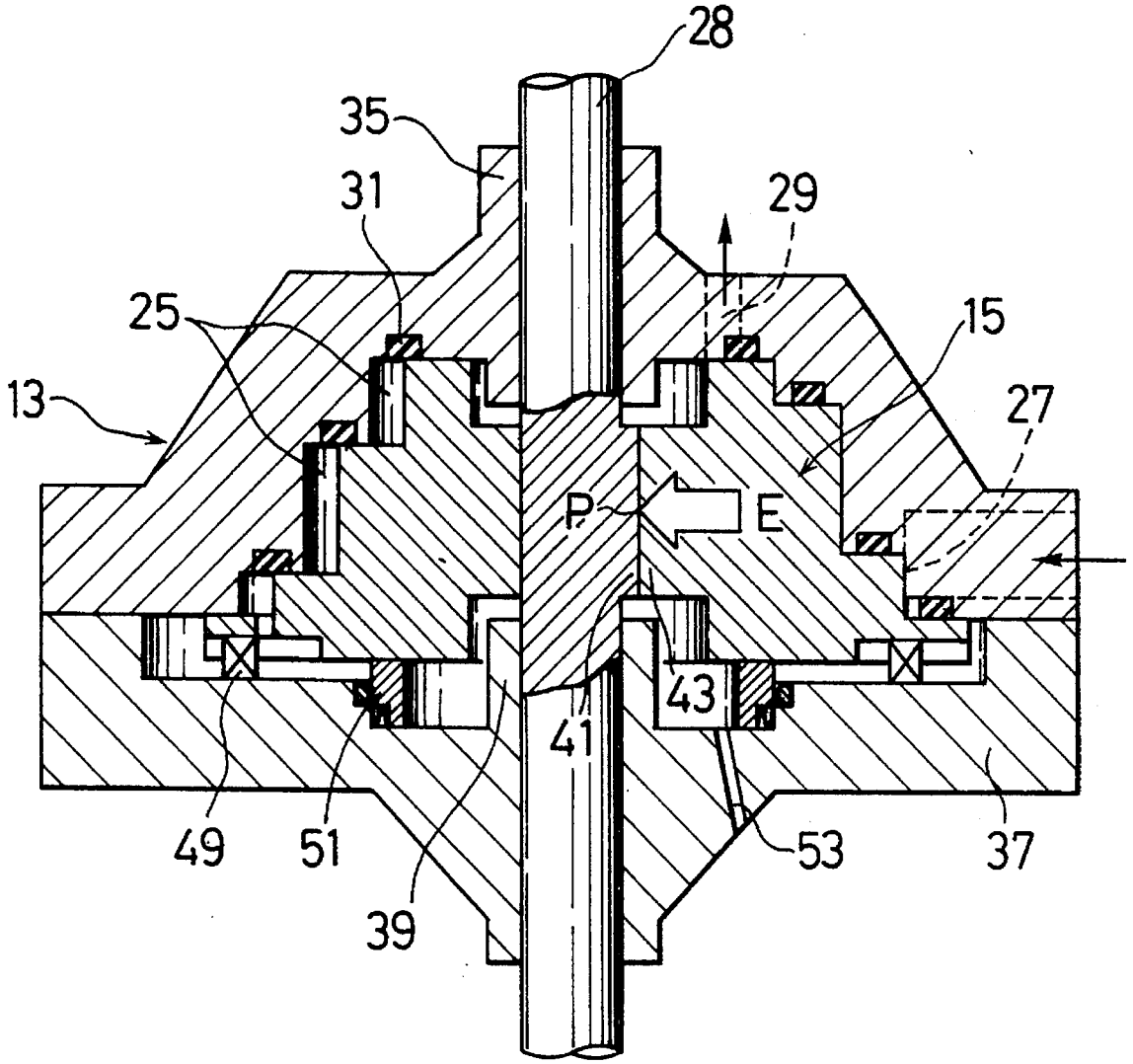
FIG. 6 illustrates and explains a gas load point acted on the revolving spiral in the fluid machine shown in FIG. 1.

FIG. 6 explains a gas load point that acts on the revolving spiral 15 in the fluid machine shown in FIG. 1.

As shown in FIG. 6, the eccentric shaft portion 41 of the main shaft 28 and the bearing portion 43 of the revolving spiral 15 are such that the main bearing 35 (upper side in the figure) and the secondary bearing 39 (lower side in the figure) are extended and made closer to the side of the eccentric shaft portion 41 so as to be close to the gas load point E, whereas a point of application in a component force of the gas load point F is held to coincide with a central portion P of the eccentric shaft portion 41. Thereby, the upsetting moment caused in the revolving spiral 15 and compression leakage due to the reverse action, a local stress concentration and so on, which are undesirably prevailed in the fluid machines having the conventional configuration such as a scroll compressor, can be minimized.

Figure 7:
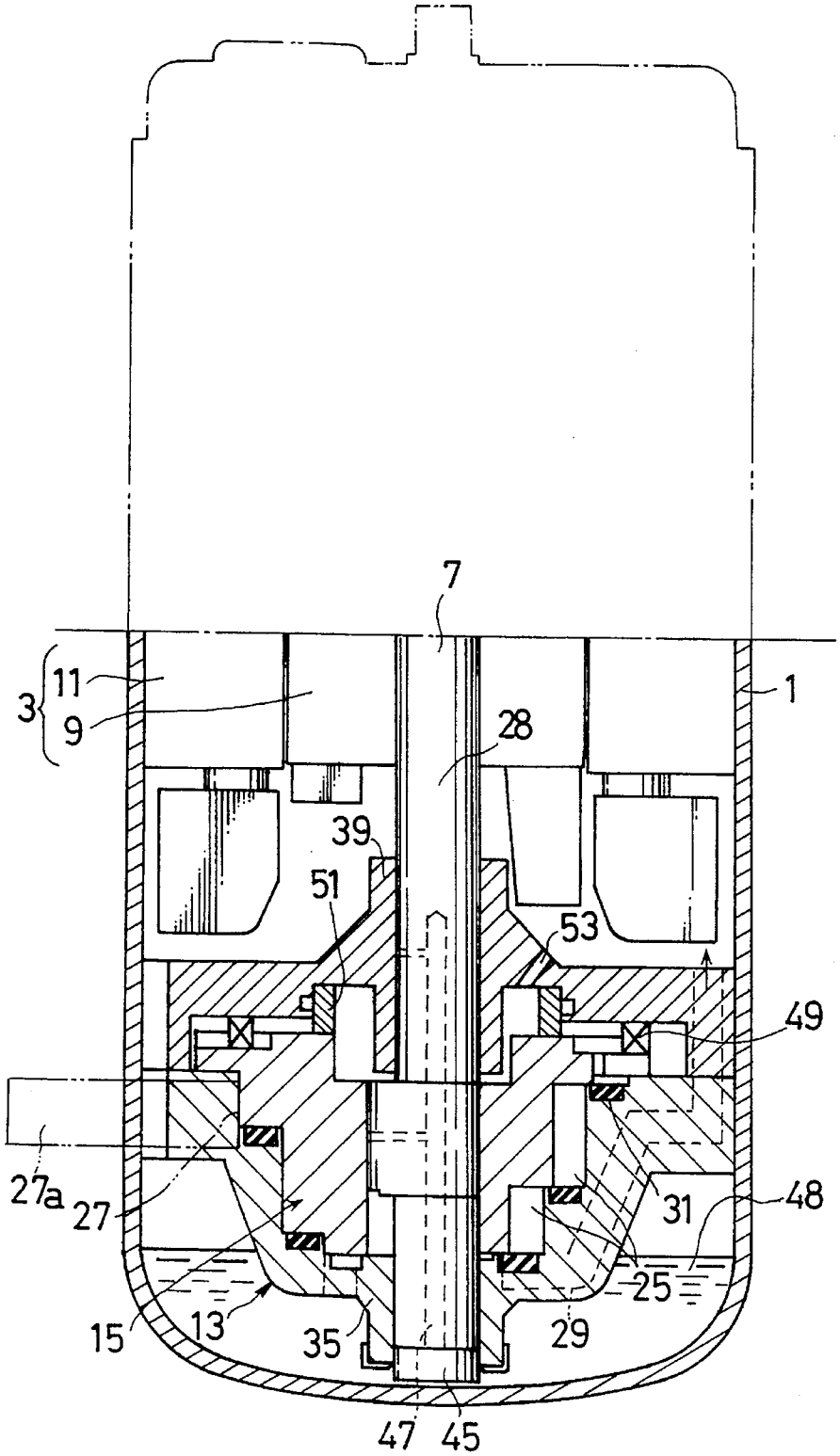
FIG. 7 illustrates directions of the revolving spiral 15 and fixed spiral 13 that constitute the compressor mechanism according to another embodiment.

FIG. 7 illustrates directions of the revolving spiral 15 and fixed spiral 13 that constitute the compression mechanism portion 5 serving as the working mechanism portion, according to another embodiment.

With reference to FIG. 7, for example, the directions of the revolving spiral 15 and fixed spiral 13 that constitute the compression mechanism 5 can be of such a configuration that the fixed spiral 13 faces downwardly and borders on within the lubricating oil 48. Thereby, achieved are a cooling operation due to the lubricating oil 48 and a noise absorbing operation by which the propagation of the noise is absorbed.

On the other hand, in the back face of the revolving spiral 15 and between the support frame 27, there are provided a rotation prevention mechanism 49 such as an Oldham ring and a thrust ring 51, respectively.

The rotation prevention mechanism 49 functions to suppress the rotation of the revolving spiral 15 at the time of rotation of the eccentric shaft portion 41, so that the revolving motion is produced to the revolving spiral 15.

The thrust ring 51 functions as a means to partition so that the discharge gas and the suction gas are taken in at an inner side and an outer side, respectively via the gas passage 53, and that a thrust force acting on the revolving spiral 15 is balanced to have an optimal value.

This discharge gas may, for example, be a refrigerant cooling gas of a chlorine system or freon system which is a refrigerant gas used for air conditioners.

In the fluid machine thus configured as above, the working gas taken in from the suction port 27 rises up from the outer circumference to the center by means of the revolving motion of the revolving spiral 15 and is compressed by the compressor space 25 in which the volume thereof is decreased gradually as height increases. Then, after the compressed gas is discharged from the discharge port 29 into the sealed casing 1, it is sent out externally from the discharge pipe 26.

During this operation, the lubricating oil is supplied to the bearing portion 43, main bearing 35 and secondary bearing 39, through an oil pump 45, so as to realize smooth operation. In the revolving spiral 15, the gas load point acts approximately on the central portion P of the bearing portion 43, and the generation of the upsetting moment and the thrust force are suppressed to their minimum. As a result thereof, a local wear and the reverse action are prevented, so that there can be obtained a stable and efficient compression state for a long period of time.

Figure 8:
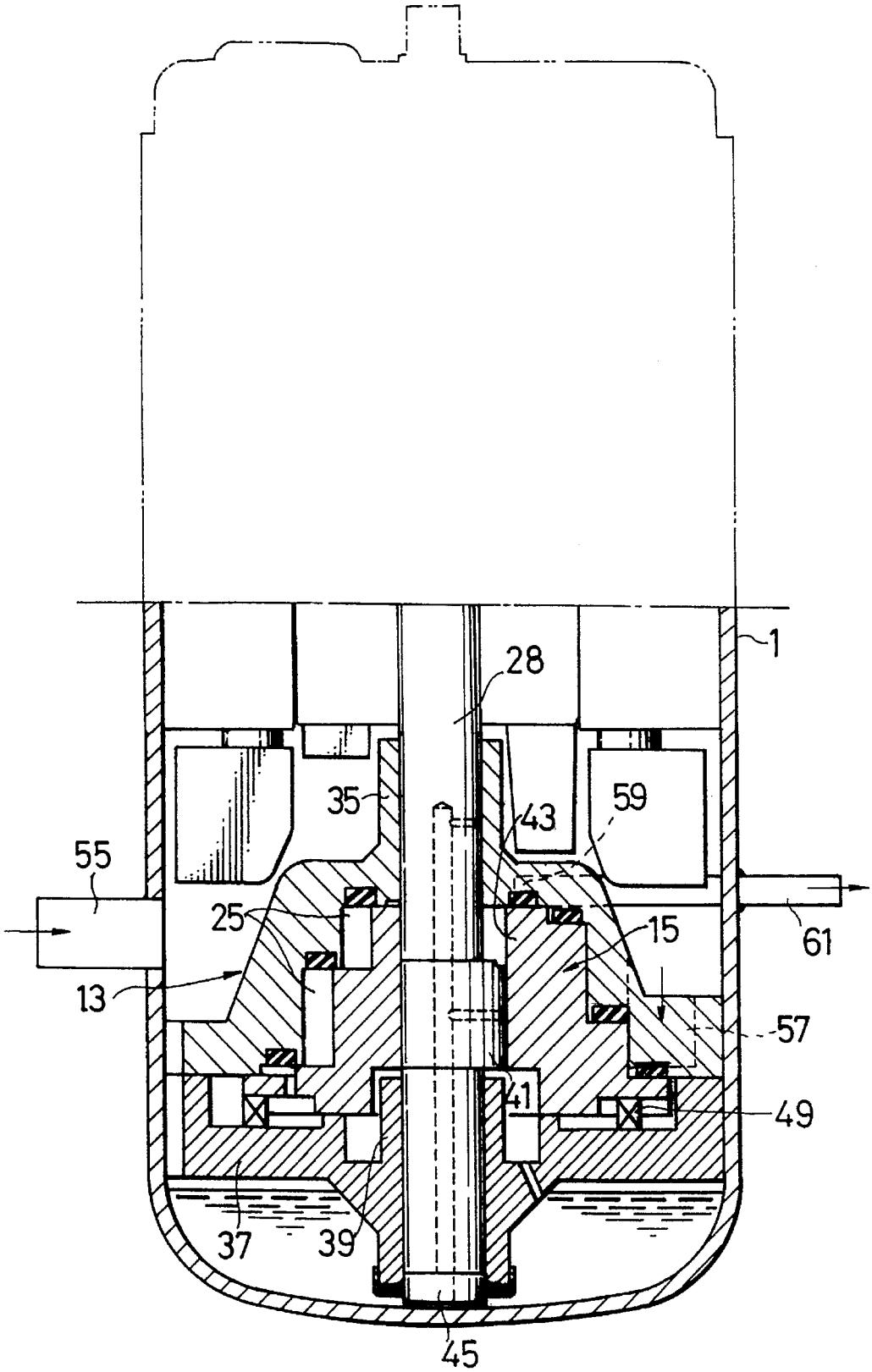
FIG. 8 shows the cross section of the fluid machine according to still another embodiment where a sealed casing 1 is filled with a suction gas.

FIG. 8 is a cross sectional view of an entire fluid machine according to still another embodiment where the sealed casing 1 is filled with the suction gas.

In other words, there is provided a suction pipe 55 in the sealed casing 1; in the outer circumference of the fixed spiral 13 there is provided a suction port 57 connected to the compressor space 25, which port is opened to within the sealed casing 1; and in the center side there is provided a discharge port 59. The discharge port 59 is directly connected to a discharge pipe 61 which is extending outwardly of the sealed casing 1.

Moreover, each functioning part for the drive motor 3 and compression mechanism portion 5 is identical to that described for the previous embodiment, and is thus given the same reference numerals.

In this embodiment, since the suction gas is filled out in the sealed casing 1 via the suction pipe 55 during the running cycle, the cooling efficiency for the entire compression mechanism portion 5 is significantly improved, so that high compressive force can be produced. Moreover, since the compressed gas can be sent out directly through the discharge pipe 61, for example, a heating operation can be possible in which a rise-up time therefor is rather quick.

Figure 9:
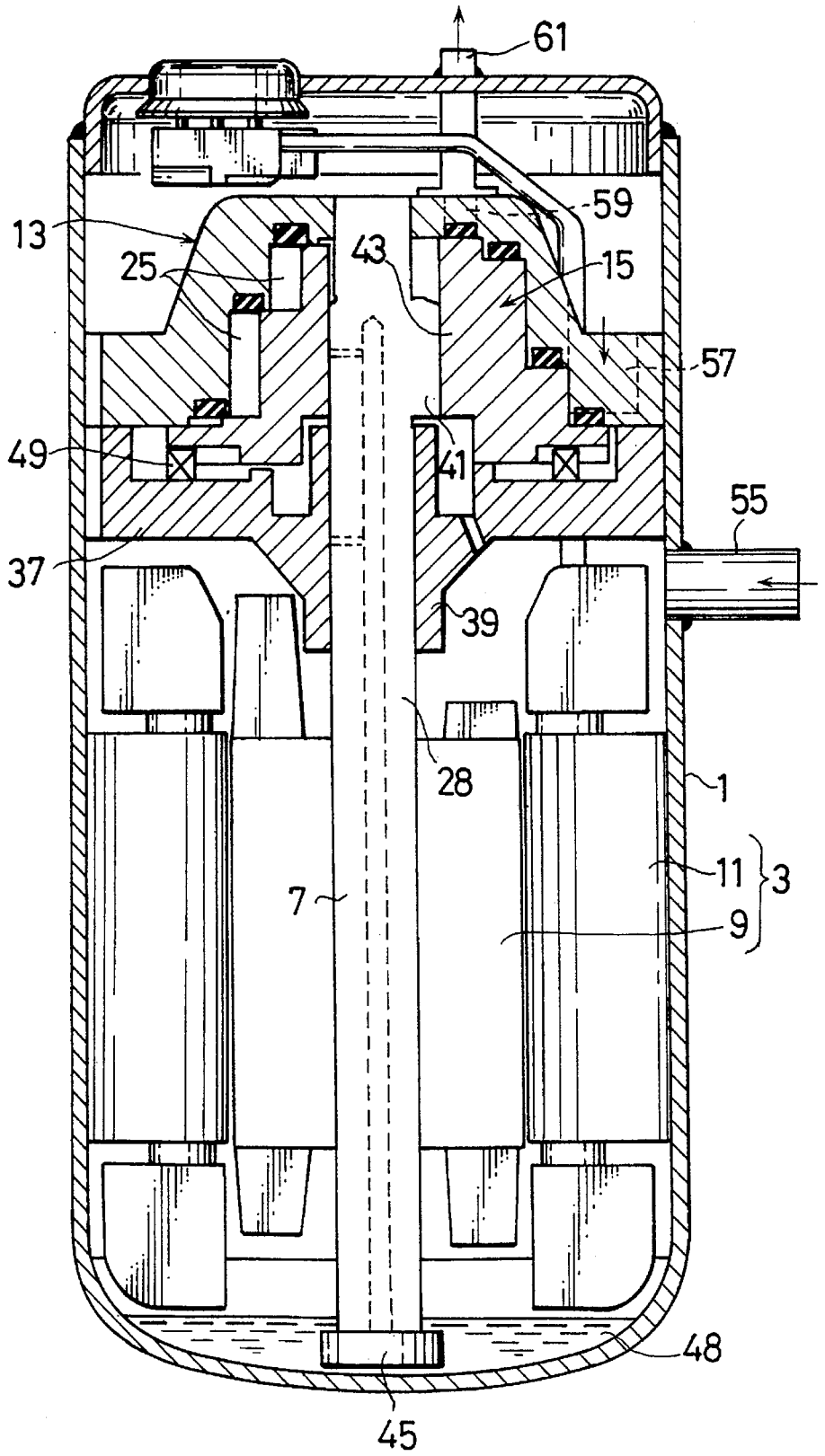
FIG. 9 shows a modified example for a layout of a drive motor and the compressor mechanism in the fluid machine shown in FIG. 8.

FIG. 9 shows a modified example over a layout of the drive motor and compression mechanism portion in the fluid machine shown in FIG. 8.

In this case, as shown in FIG. 9, the compression mechanism portion 5 is provided in an upper side and the drive motor 3 is disposed under the compression mechanism portion 5. Therefore, particularly in the winter period, the compression mechanism portion 5 is not affected by the lubricating oil state cooled by the cold outside air. Thus, the heating operation where the rise-up time therefor can be further faster realized.

Next, let us describe hereinbelow as to the spiral shapes of the fixed spiral 13 and revolving spiral 15 in the fluid machine according to the present invention.

In the structure of the conventional scroll type compressor, for example, the inflow gas is compressed only in a radial direction of the spiral, so that the shape of the scroll almost determines the compression process. In contrast thereto, in the structure of the fixed spiral and revolving spiral according to the present invention, the inflow gas is compressed in the radial direction and axial direction (three-dimensional direction). Therefore, the spiral shape and the height for the spiral can be freely set, so that the compression process can be freely designed.

Moreover, in the conventional scroll type structure, the inside and outside of the scroll need be processed with much accuracy. In contrast thereto, in the structure of the fluid machine according to the present invention, only a half side of the spiral in the revolving spiral need be processed with accuracy, so that the processing therefor is simpler and the configuration realized thereby becomes also simple.

Moreover, the bearings of the revolving spiral can be provided on both sides of the compressor space serving as the working space, so that a further stable operation is possible in comparison to the structure supported only at a single side in the conventional scroll configuration.

With reference to FIG. 10 through FIG. 20, the spiral shapes for the fixed spiral and revolving spiral (motion spiral) in the fluid machine according to the invention will be described in detail.

For the sake of explaining embodiments according to the present invention, let us take an example of the compressor hereinbelow. The present invention illustrated thereby can also be applied to the expansion machine and pump so as to obtain the same advantageous effects.

Figure 10:
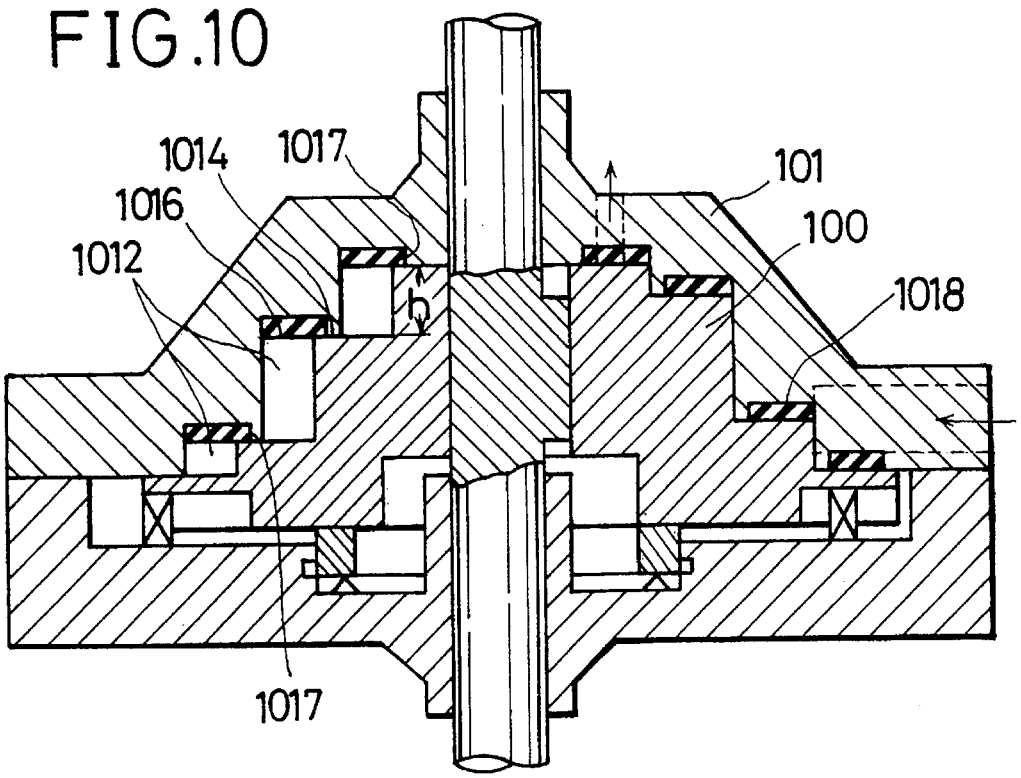
FIG. 10 shows a cross section of configuration of a compressor mechanism portion, which is an example of the fluid machine.

FIG. 10 is a cross section showing a brief configuration of the compression mechanism portion. The reference numeral 100 denotes a moving spiral, 101 a fixed spiral, 1012 denotes a compressor space between the moving spiral 100 (revolving spiral) and the fixed spiral 101, 1018 a chip seal, and 1014 and 1016 denotes step-formed portions.

Figure 11:
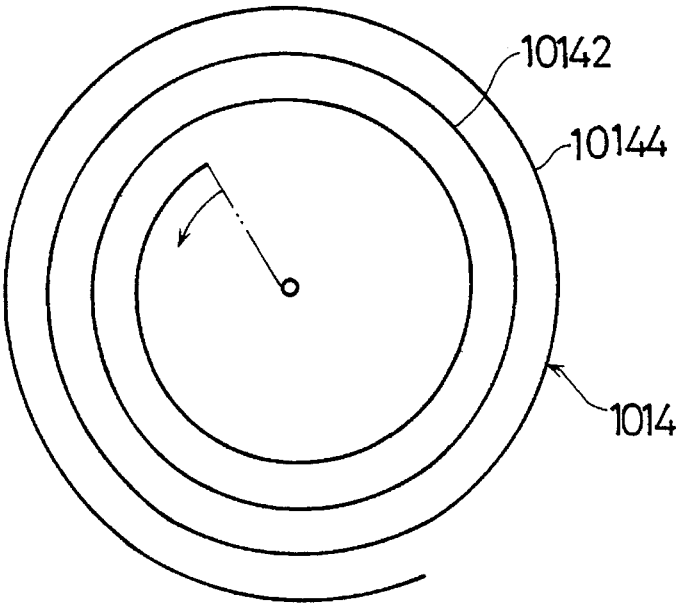
FIG. 11 shows a spiral shape, as a spiral shape line for an outline contour, utilizing an involute of circle.

FIG. 11 is a spiral shape utilizing an involute of a circle, as a spiral contour line of an outer form 102 in the compression mechanism portion shown in FIG. 10.

With reference to FIG. 12, viewed from the top, showing a state in which the revolving spiral 100 (moving spiral)100 and the fixed spiral 101 are combined, the compression principle will be described.

Figure 12A:
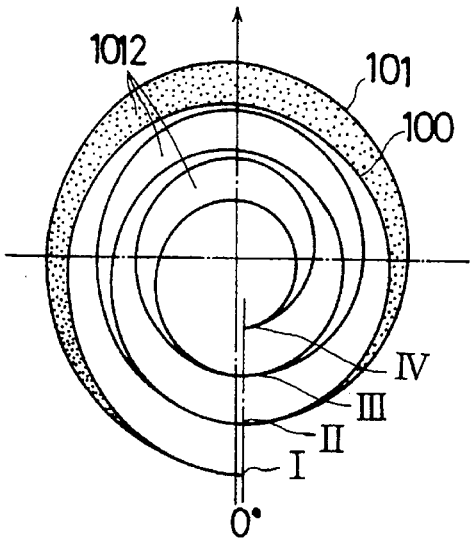
FIG. 12A–FIG. 12D are top views showing the revolving spiral (moving spiral) and the fixed spiral in the case of the involute of circle shown in FIG. 11 combined together.
Figure 12B:
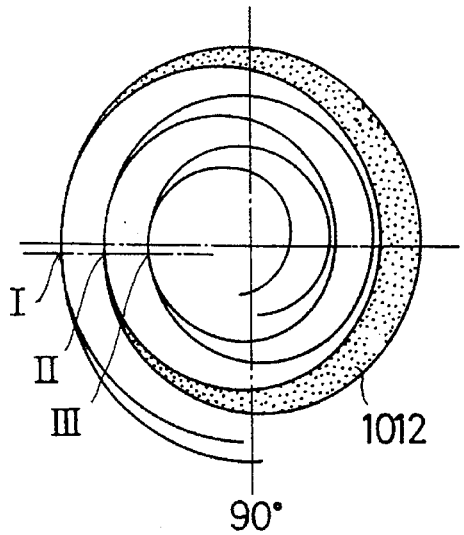
Figure 12D:
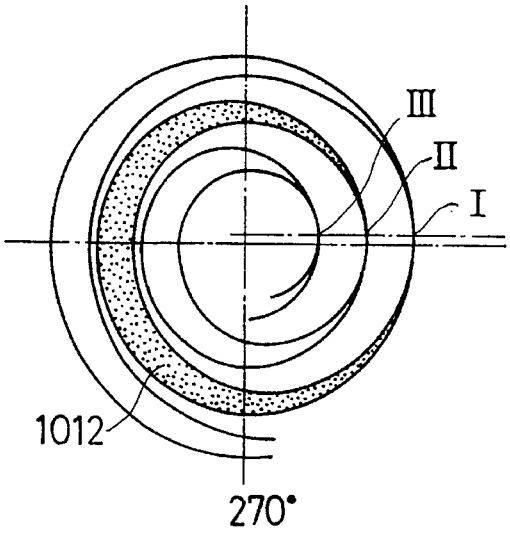
Figure 12C:
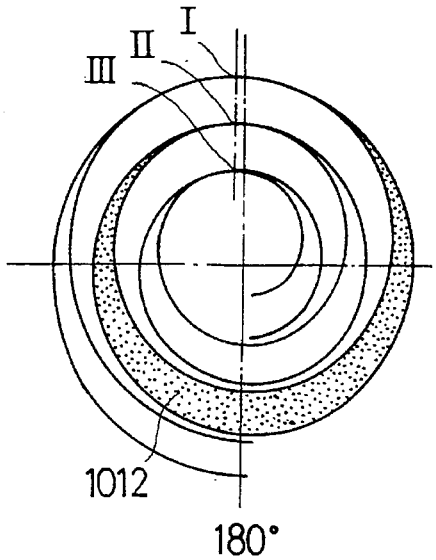

FIG. 12A shows the state in which the suction is completed. In this case, there are four proximity points indicated with I, II, III and IV in FIG. 12 where the moving spiral 100 is located closest to the fixed spiral 101.

These proximity points are displaced toward the X-axis by a basic circular radius from the Y axis. A dotted area of the compressor space 1012 is of a 360°-wound crescent moon shape. From this state, the moving spiral 100 (revolving spiral) shifts by 90° clockwise, and then the innermost proximity point IV disappears. Thus, when the compressor space 1012 is also shifted by 90° clockwise, and a center thereof is also shifted accordingly. As a result, the area of the crescent moon shape viewed from the top in the compressor space is decreased. show states as are rotated further by 90°, respectively.

In this manner, the compressor space 1012 shifts its position consecutively inwardly, the area viewed from the top decreases. Moreover, the height-dimensional pitch 4 for the compressor space 1012 can be freely set, so that the size of the compressor space 1012 can be freely set regardless of the crescent moon size viewed from the top. Therefore, the compressing processes can also be freely set. In other words, it is possible to compress rapidly and slowly.

Though the circle is utilized as the involute shape in FIG. 12, a straight line or regular polygon can be constructed in a similar manner.

Moreover, in addition to the involute as the spiral shape, an Archimedes spiral or logarithmic spiral can be utilized.

Figure 13:
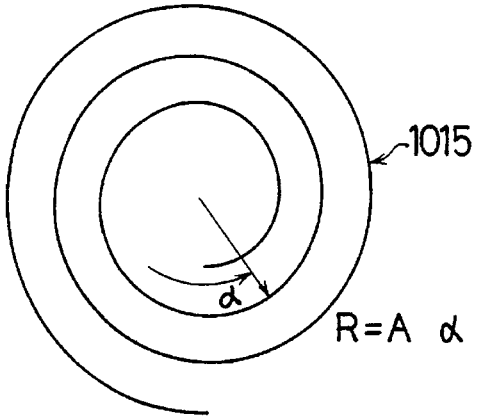
FIG. 13 shows an example of the Archimedes spiral.
Figure 14A:
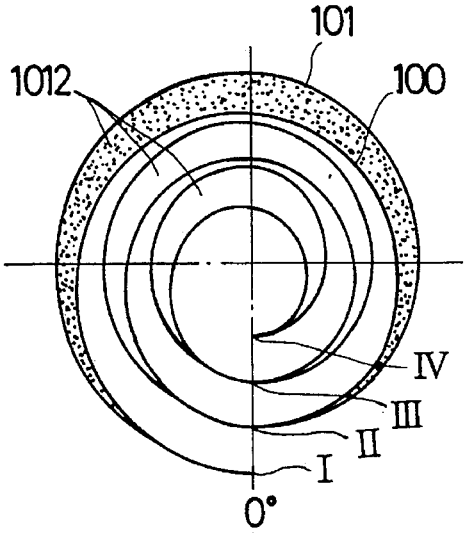
FIG. 14A–FIG. 14D are top views showing compressed states where the revolving spiral and the fixed spiral in the case of the Archimedes spiral shown in FIG. 13 are combined together.
Figure 14B:
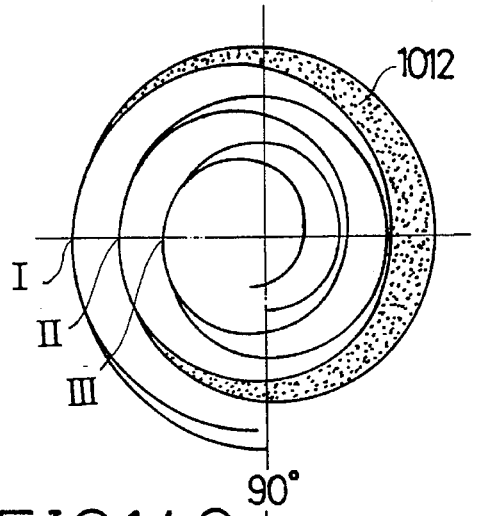
Figure 14D:
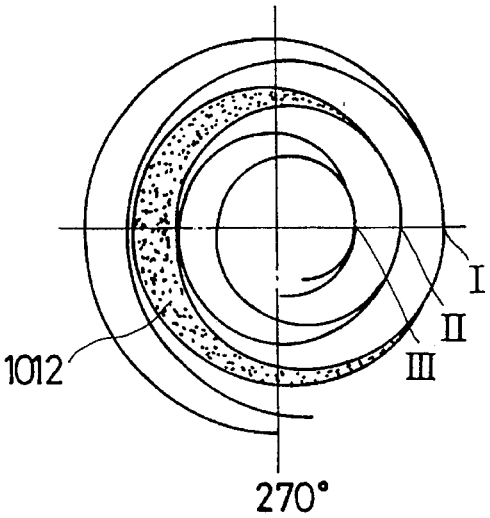
Figure 14C:
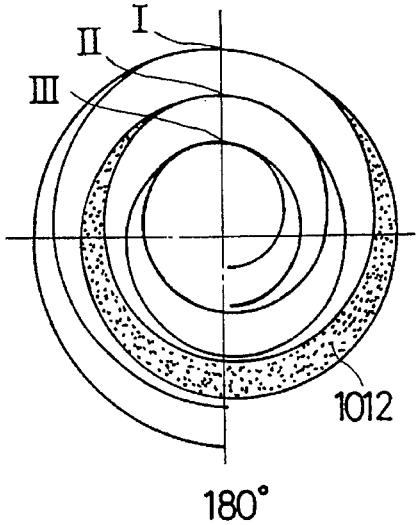

In polar coordinates, the Archimedes spiral and the logarithmic spiral can be constructed based on equations $R=A*\alpha$ and $R=A*LOG(N*\alpha)$, respectively. In the equations, R indicates a radius, A and N are constants, and $\alpha$ indicates an angle. An example of the Archimedes spiral is shown in FIG. 13. FIG. 14 (which is the top view of the compression state where the moving spiral 100 is combined together with the fixed spiral 101).

Figure 15:
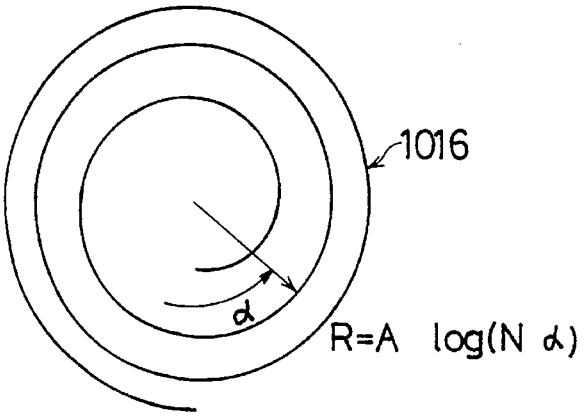
FIG. 15 shows a logarithmic spiral as a spiral shape.
Figure 16A:
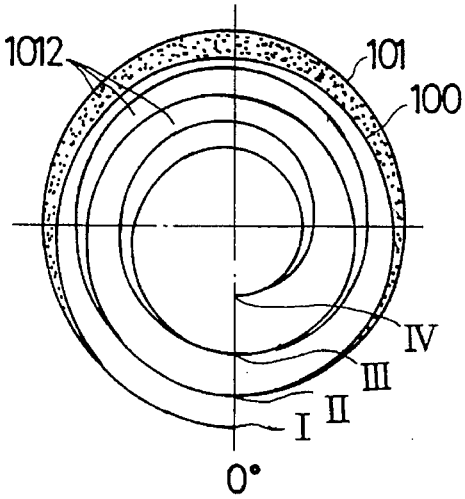
FIG. 16A–FIG. 16D are top view showing compressed states where the revolving spiral and the fixed spiral in the case of the logarithmic spiral shown in FIG. 15 are combined together.
Figure 16B:
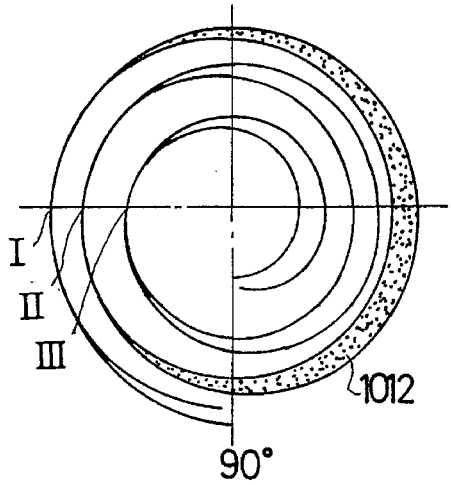
Figure 16D:
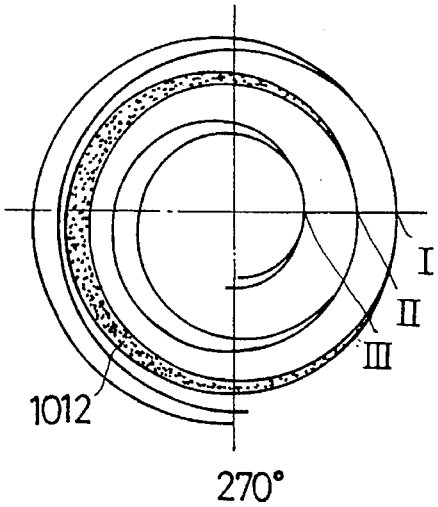
Figure 16C:
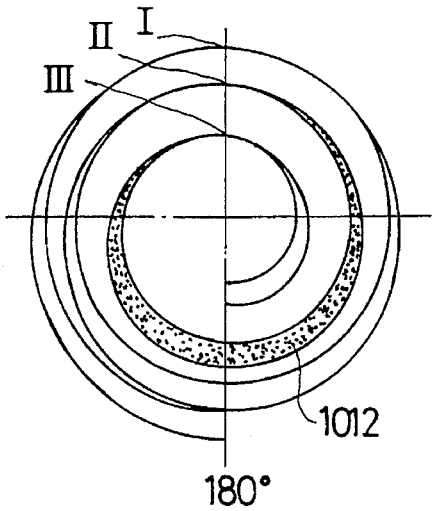

An example for the logarithmic example is shown in FIG. 15 and FIG. 16 (which is the top view of the compression state where the moving spiral 100 is combined to the fixed spiral 101).

In the logarithmic spiral, the spiral's radial pitch is narrow outwardly, and becomes wider toward inwardly. Therefore, the seal length for each step-formed portion 1014, 1016 for the moving spiral 100 and the fixed spiral 101 can be set longer. As a result, the leakage of the high-pressure gas inside can be prevented, thus realizing a highly efficient fluid machine.

As for radial height dimension of the step-formed portion 1014 in the moving spiral 100, if, for example, an inside 10142 and an outside 10144 of the spiral shown in FIG. 11 are set to the same height on a radial line from the spiral center or on a tangent line of spiral's basic circle, the occurrence of torsions in the chip seal 1018 in the spiral direction can be prevented in the event that the step-formed portion 1014 scrubs with the chip seal 1018. Therefore, leakage in a sliding portion can be reduced so as to improve the efficiency, and the deformation applied to the chip seal is due to bending only in the direction along with the spiral, so that reliability of the chip seal can be improved.

Figure 17:
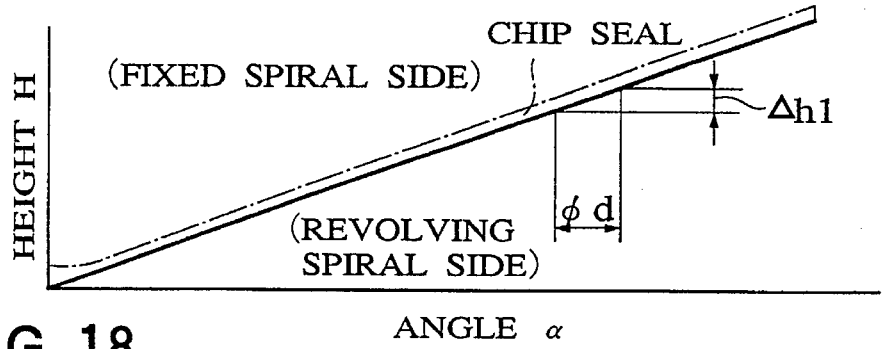
FIG. 17 shows a graph indicating that the relationship between the angle α along with the spiral from the outer side of the spiral, and height H is linear.

As for height dimension for the step-formed portion 1014 of the moving spiral 100 and the step-formed portion 1016 of the fixed spiral 101, the case where the relation between angle $\alpha$ and height H along with the spiral from the outside of the spiral is linear is shown in FIG. 17.

Figure 18:
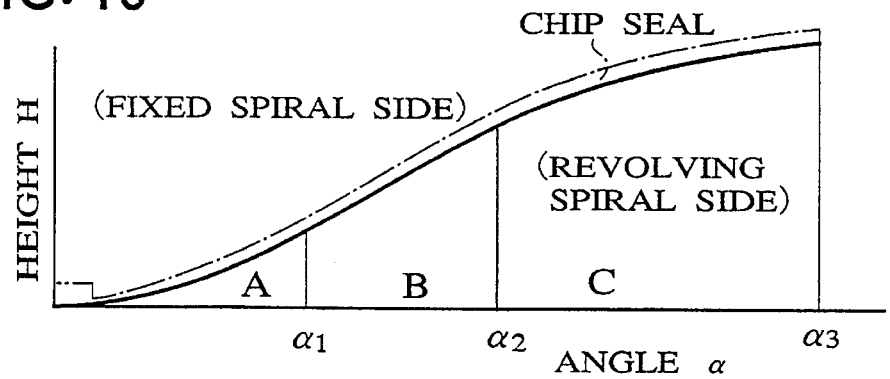
FIG. 18 illustrates a graph showing the relationship between the angle α and the height H.

FIG. 18 illustrates each configuration when the correlation between $\alpha$ and H is of concave down where $\alpha1<\alpha2<\alpha3$ and $0\leqq\alpha\leqq\alpha1$ (A); the correlation therebetween is linear where $\alpha1\leqq\alpha\leqq\alpha2$ (B); and the correlation therebetween is of concave up where $\alpha2\leqq\alpha\leqq\alpha3$ (C).

If the curve has a tangent line parallel to the axis of angle $\alpha$ in the range of (A)–(C) as shown in FIG. 18, there will be no inflection points at the start and end of spiral winding. As a result, the sliding between the spiral and chip seal becomes very smooth so as to improve the reliability.

Besides the spiral shapes, an elimination area is a function between height H1 in the range of $0° \leqq \alpha \leqq 360°$ and difference $\Delta H$ of height H2 in the range of $360° \leqq \alpha \leqq 720°$. In other words, the elimination area can be taken at a larger quantity as $\Delta H$ is larger.

As shown in FIG. 18, if the curve is manipulated such that it is of concave down in the range of $0° \leqq \alpha \leqq 360°$, the elimination area can be taken at a large quantity. That is, an increased capacity can be obtained with the same size of the conventional compressor.

In order to further improve this advantageous effect, if the curve is manipulated such that it is of concave up in the rage of $360° \leqq \alpha \leqq 720°$, further increased quantity of elimination area can be obtained. Of course, even if the straight line is combined to the above curve, the large elimination area can also be obtained.

Moreover, when the concave-up curve is set in the range where angle $\alpha$ is large, height S in the axial direction of the compression mechanism portion as the working mechanism portion can be kept at a low level. Therefore, the compressor can be compact-sized.

The above-described relationship is merely an example. Though there are indicated curves or lines in each of three ranges as $\alpha$'s range in the above example, the correlation of $\alpha$ and H may be expressed by a single equation without definitely defining the range. Or, the $\alpha$'s range may be partitioned into plural ones so that the curve is of concave down in a range where the $\alpha$ is small while it is of concave up in a range where the $\alpha$ is large. Thereby, the same advantages can be obtained. Moreover, though the straight line is inserted in the middle, this is not a necessary condition to achieve the above target.

Figure 19:
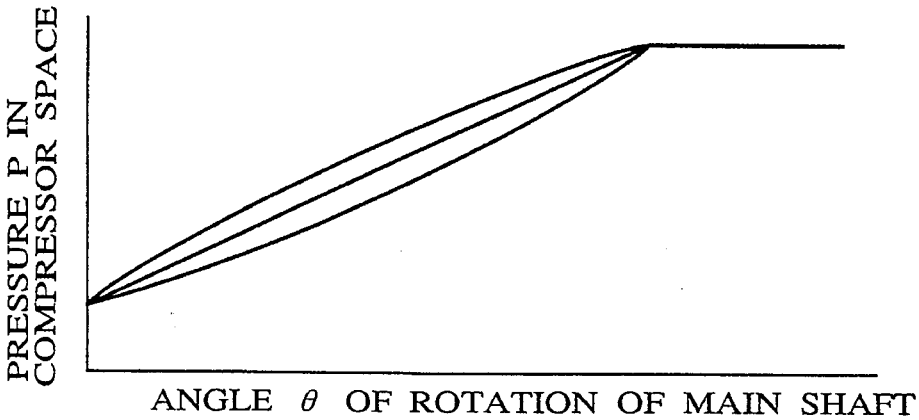
FIG. 19 is a graph showing the relationship between the angle θ of rotation for the main shaft (from suction completed time θ=0°) and a pressure in a compressor space.

FIG. 19 shows a function of pressure P in the compressor space 1012 from $\theta=0$ at the time of suction completion, where correlation between the angle $\theta$ of rotation for the main shaft and pressure P in the compressor space 1012 is calculated.

As shown in FIG. 19, the relation between $\theta$ and P can be arbitrarily selected. Therefore, the pressure difference can be set for a large quantity for the compressor space 1012 where enough sealing is possible, while the pressure difference can be set for a small quantity for the compressor space in which enough sealing is not possible. Since the spiral height dimension H can be selected accordingly, a highly efficient fluid machine can be constructed.

Moreover, a plurality of stage difference portions 101 are provided in a slant face of the step-formed portion 1016 in the fixed spiral 101. The shape of the chip seal is made such that the face having contact with the fixed spiral is one with the stage difference, and a continuous slant face is formed in the side of the moving spiral (revolving spiral) 100, in order to be placed inside this stage difference portion 1017.

Moreover, the relation between $\Delta h$ and $\Delta h1$ (see FIG. 17) is set to $\Delta h > \Delta h1$, where $\Delta h$ indicates the height of the stage difference portion 1017 and $\Delta h1$ indicates the height difference corresponding to a revolving diameter $\phi d$ when the slant face of the step-formed portion in the moving spiral (revolving spiral) 100 is revolved.

With the above conditions, prevented is the movement of the chip seal along the spiral from a high-pressure side to low-pressure side due to the fact that the chip seal receives the pressure difference during the operation. Also prevented is the movement of the chip seal along the spiral due to frictional force of the revolving motion, thus achieving a stable operation.

Figure 20:
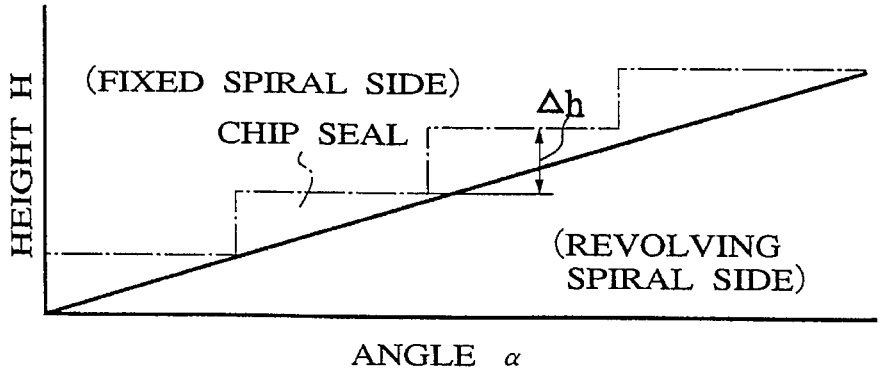
FIG. 20 shows correlation between α and H, developing along the spiral the state of stage difference in the fixed spiral.

As an example for the stage difference, FIG. 20 is a graph showing $\alpha$-H relationship, developing along the spiral the state of the stage difference in the fixed spiral 101.

Though in the above example in FIG. 20 the step-formed portion 1019 (except for the stage difference portion 1017) is constructed parallel to the shaft having angle $\alpha$, the same advantageous effects can be obtained even if a slope is given thereto.

Though in the above example the stage difference portion is provided in a fixed spiral side, the same advantageous effects can be obtained even if it is provided in a moving spiral (revolving spiral) side and a continuous slope is given to the fixed spiral side.

These stage differences are preferably provided to a winding start portion of the spiral when the friction of the chip seal and spiral is rather large, while they are preferably provided to a winding end portion of the spiral when the pressure difference between suction and discharge is large. Moreover, when both the friction and the pressure difference are significantly large, they are preferably provided at both ends of suction and discharge, so that unstable movement of the chip seal can be prevented.

Let us describe hereinafter concerning the chip seals utilized in the fluid machine in each embodiment, with reference to FIGS. 21 through FIG. 36.

Figure 21:
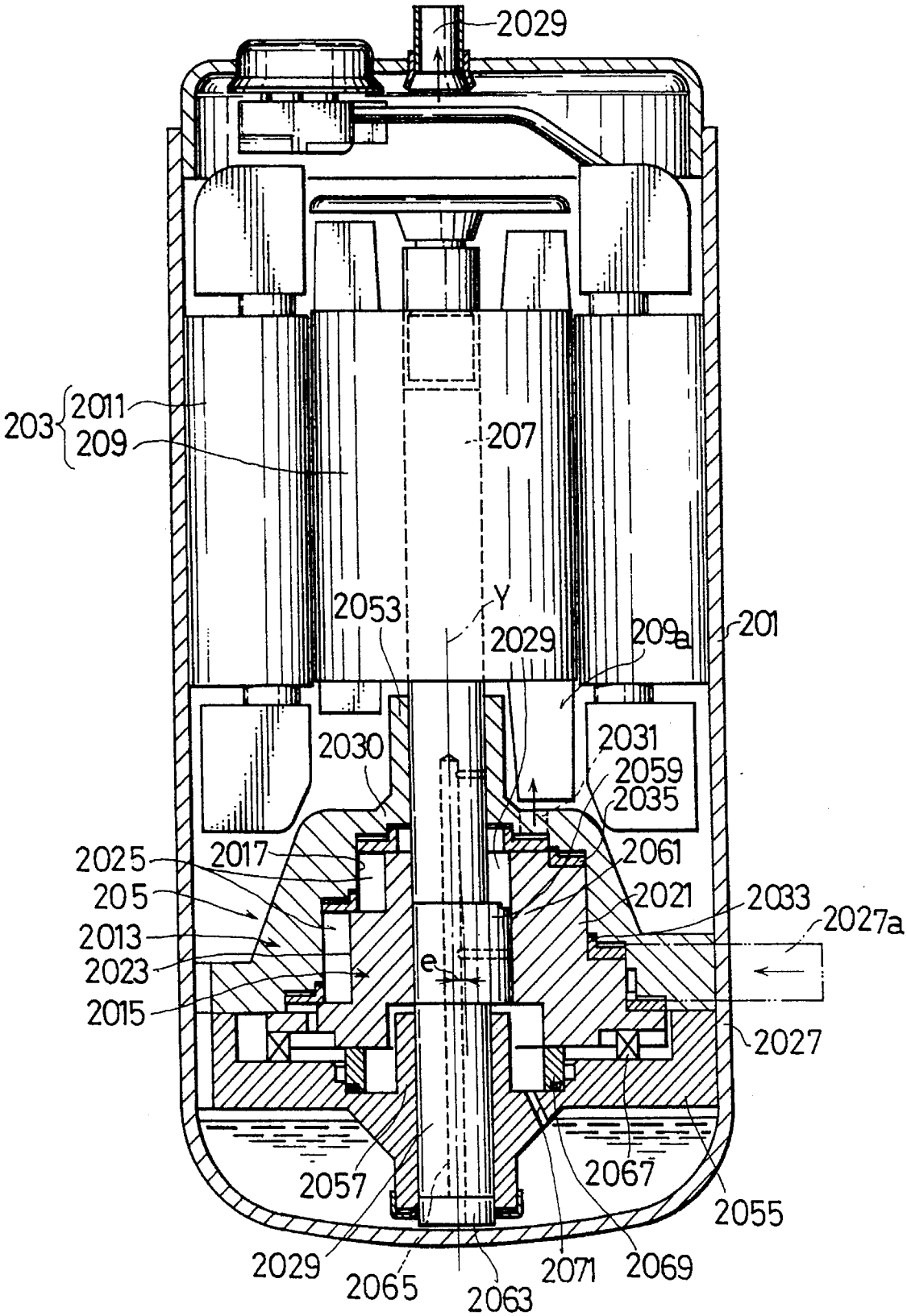
FIG. 21 is a cross sectional view, showing an entire fluid machine according to still another embodiment.

In FIG. 21, the reference numeral 201 denotes a sealed casing, and a drive motor 203 and a compression mechanism portion 205 are provided within the sealed casing 201.

The drive motor 203 includes a rotor 209 fixed to a main shaft 207, and a stator 2011 fixed and supported in an inner wall of the sealed casing 201. When electric current flows through the stator 2011, rotation power is generated to the main shaft 207 via the rotor 209.

The compression mechanism portion 205 comprises a fixed spiral 2013 serving as the second spiral, and a revolving spiral 2015 serving as the first spiral, and a main shaft 2029 continuously integrated with the main shaft 207 penetrates therethrough.

Figure 22A:
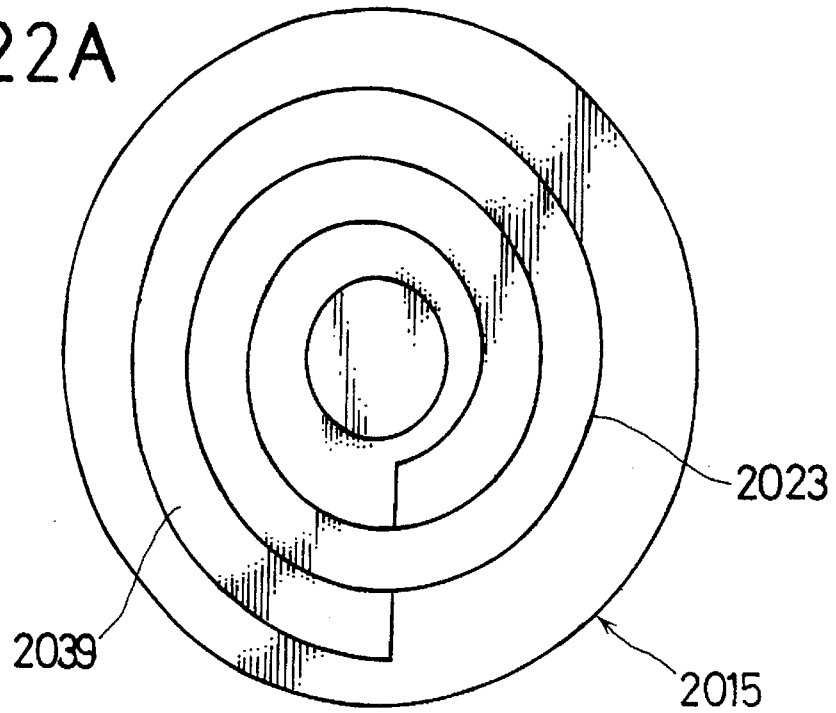
FIG. 22A is a plan view of the revolving spiral and FIG. 22B illustrates how a fixed spiral and a revolving spiral are engaged to each other.
Figure 22B:
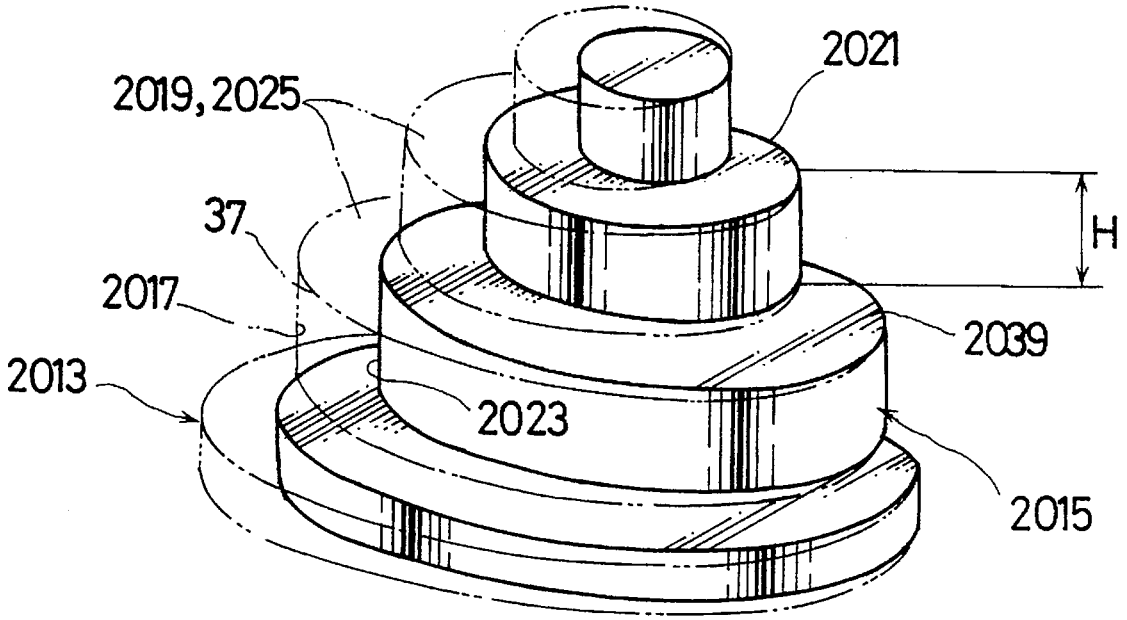

As shown in FIG. 22A and FIG. 22B, the fixed spiral 2013 is formed such that the radius of a spiral-shaped inner engagement face 2017 is gradually decreased from the outer circumference toward a center thereof so that a spiral-shape spiral space 2019 is formed, and the fixed spiral 2013 is fixed to and supported by the inner wall surface of the sealed casing 201.

The revolving spiral 2015, as shown in FIG. 22A and FIG. 22B, includes a spiral body 2021 that rises up in a spiral shape outwardly from the outer circumference toward a core thereof and whose radius is consecutively decreased toward the core, and the outer circumference of the spiral body 2021 becomes an inner engagement face 2023.

An outer engagement face 2023 of the spiral body 2021 is engaged with the inner engagement face 2013 at the side of the fixed spiral 2013, so that a compressor space is formed. Therefore, the processing accuracy can be determined only by controlling the outer engagement face 2023 and inner engagement face.

Figure 23:
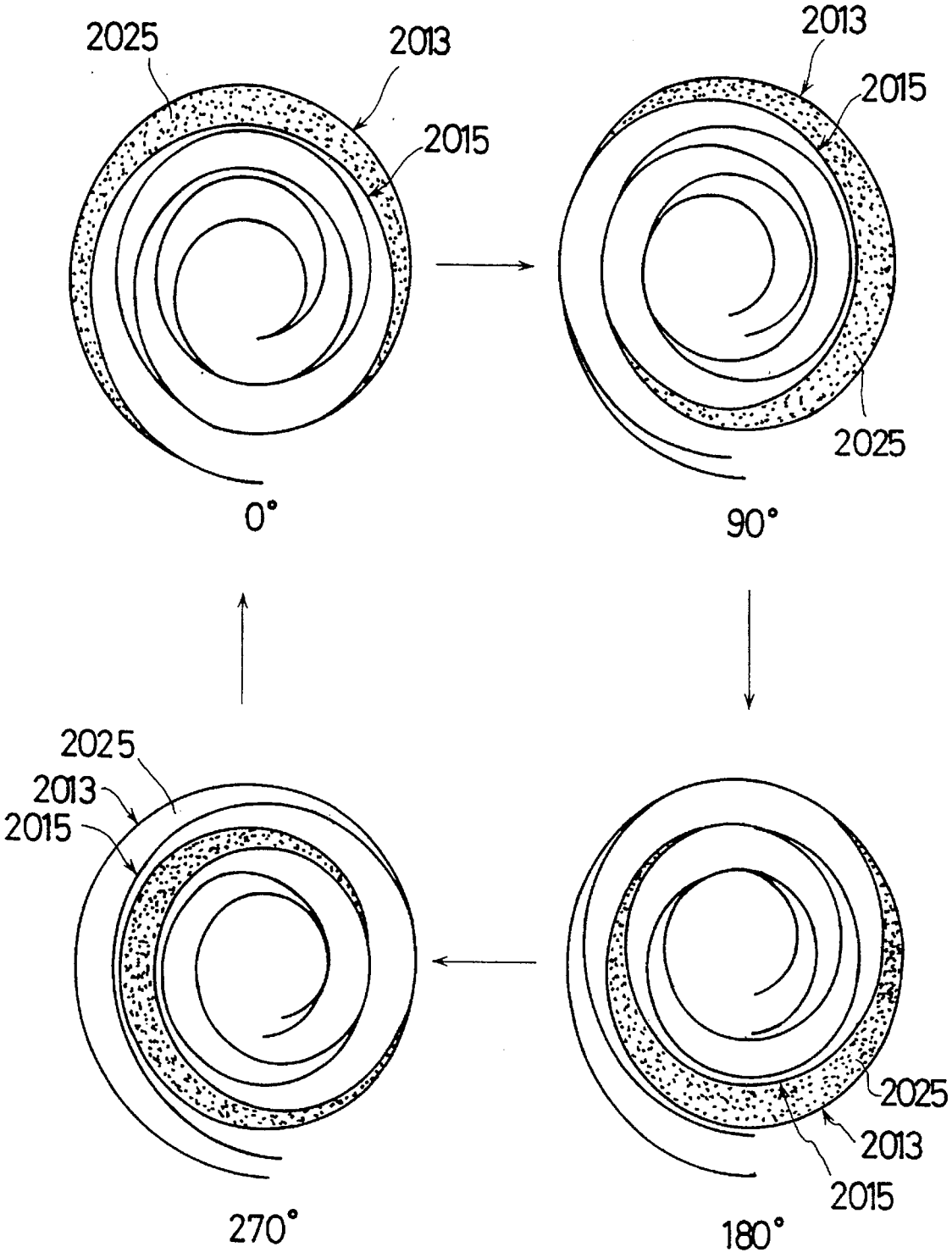
FIG. 23 illustrates and explains operations in compression processes.

The compressor space 25 is respectively connected to the suction port 2027 directly connected to suction pipe 2027*a* extended externally of the sealed casing 201, a discharge pipe 2027 provided in an upper portion of the sealed casing 201, and the discharge port 2031 producing inner space inside the sealed casing 201. Thereby, the revolving motion is generated to the revolving spiral 2015, so that the working gas from the suction port 2027 is moved toward the center and discharged finally from the discharge port 2031 accompanied by the decrease of volume thereof, as shown in FIG. 21 and FIG. 23.

In this case, it is preferable that there is provided a check valve (not shown) in the suction port 2027 or discharge port 2031. Thereby, counterflow of gas in the event of rotation stoppage can be prevented.

Figure 24:
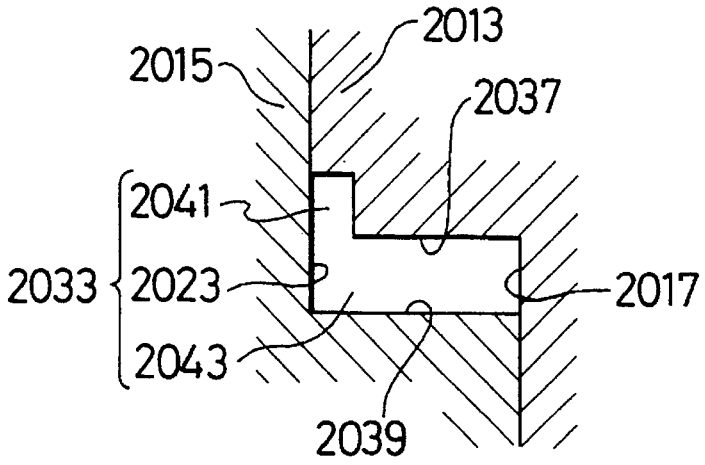
FIG. 24 is a cross section showing a partial closed space.
Figure 25:
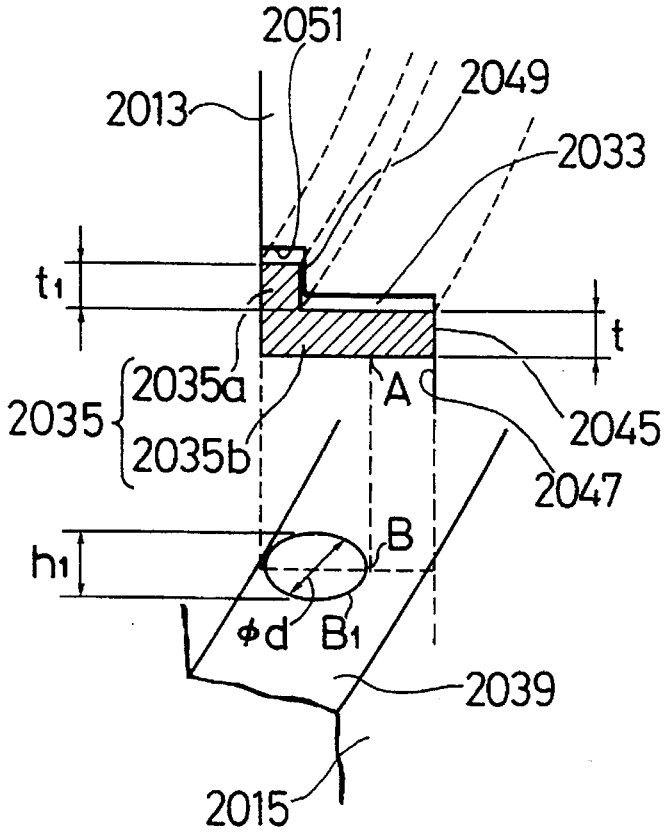
FIG. 25 illustrates and explains relation between a seal member, the closed space and a step surface at a revolving spiral side.

Moreover, as another advantageous aspect, the discharge port 2031 is closely located to an edge 209*a* of the rotor 209, so that the rotation of rotor 209 makes possible that oil in gas discharged from the discharge port 2031 can be separated. In the compressor space 2025, the compression volume is determined by a pitch H of cross-section step-formed shape in addition to the radial direction of the spiral, and there is provided a seal by a seal member 2035 disposed in a closed space 2033, as shown in FIG. 24 and FIG. 25.

The closed space 2033 is of cross-section L shape that comprises a vertical portion 41 and a horizontal portion 2043 formed such that a step surface 2037 of outer engagement surface 2017 in the fixed spiral 2013 is spirally connected to a step surface 2039 of inner engagement surface 2023 in the revolving spiral 2015. As shown in FIG. 25 (which is a development and explanation figure where the step surface 2039 and the seal member 2035 are separated), the seal member 2035 is formed to have a cross-section L-shape spiral that comprises a sub-seal portion 2035*a* facing within the vertical portion 2041 forming the the closed space 2033, and a seal portion main body 2035*b* facing the horizontal portion 2043. Thickness t of the seal portion main body 2035*b* and thickness t1 of the sub-seal portion 2035*a* are greater than high-low variable width h1 caused by the revolution of the revolving spiral 2015.

In other words, if point A where there is the seal member 2035 is viewed from a point of a slope surface where each step surface 2037, 2039 becomes upwardly slanted at the time of revolving operation of the revolving spiral 2015, point A is in contact with point B of a slanted step surface 39. In these contact points, point B is revolved accompanied by the revolving motion of the revolving spiral 2015, and is moved from point A. Observing this movement, another point B1 of the step surface 2039 becomes in contact with point A. A group of point B1 in contact with point A becomes a closed curve where a circle with the revolving diameter $\phi d$ is projected on the step surface 2039. Since point A is in contact with a slope-shaped closed curve, it is moved toward the same height dimensional axis with high-low difference h1 in the axial direction of the closed curve.

Therefore, the thickness t of the seal member 2035 is made greater than the high-low difference h1, so that a side face 2045 of seal portion main body 2035*b* in the seal member 2035 slides in the up-down directions, having a side wall 2047 of the fixed spiral 2013 and a lap area $\alpha$ of a predetermined width. Then, the width for movement by the sliding is h1, so that a seal state is definitely secured against the side wall 2047 of the fixed spiral 2013 by the lap area.

Moreover, a side surface 2049 of a sub-seal portion 2035*a*, which has a side wall 2051 of a vertical portion 2041 and the lap area, slides in the up-down directions in a similar manner with the seal portion main body 2035*b*, so that there can be definitely obtained a seal state.

Figure 26:
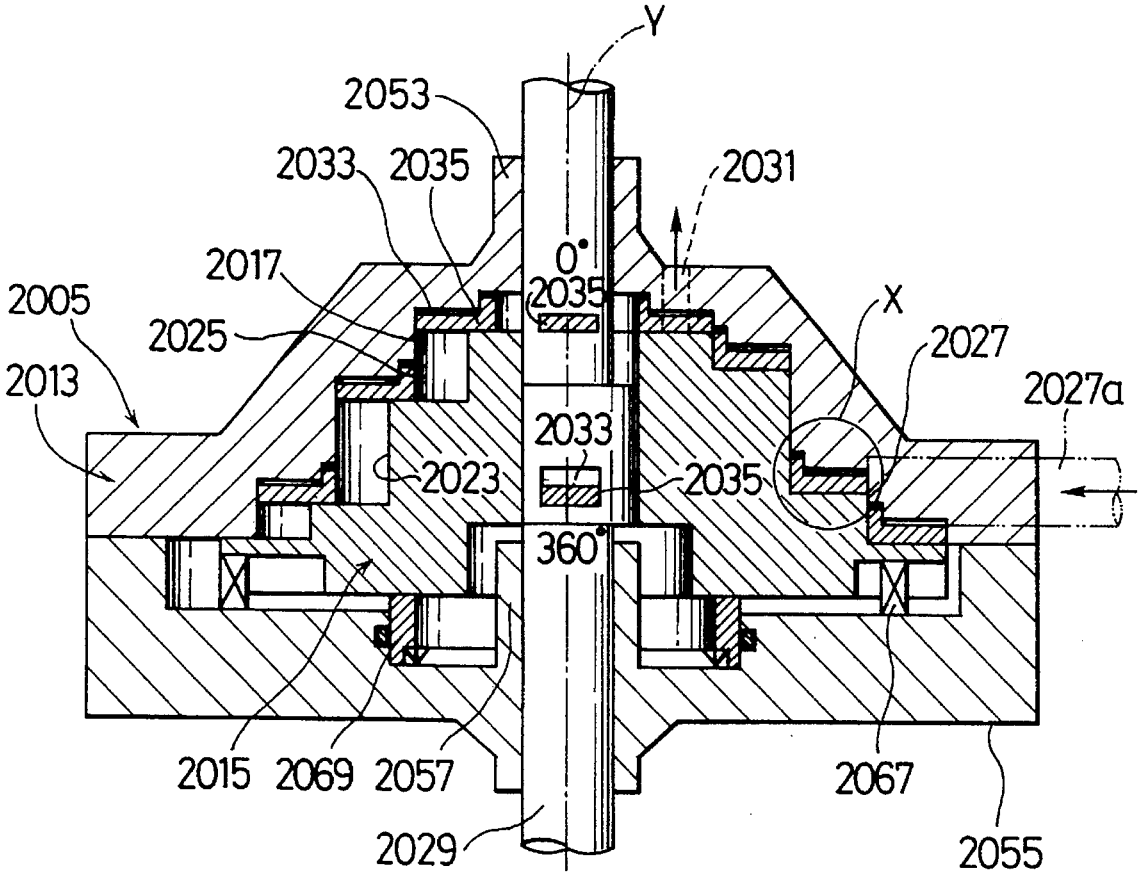
FIG. 26 is a cross sectional view showing a compressor mechanism portion shown in FIG. 21.

The relationship between the seal member 2035 and the closed space 2033 is illustrated in FIG. 26. For example, suppose that at the time of instant stoppage of the revolving motion, the left side in the figure is 90°, the right side is 180° about the shaft center Y, and the reverse side is 0° and the front side is 360° from the shaft center Y. Then, at the position of 0°, the closed space 2033 is in the zero sealed state. At the position of 360°, the closed space 2033 becomes a maximum state as indicated by a dotted line.

As material for the seal member 2035, preferable is material whose majority is composed of the engineer plastic such as liquid crystal polymer with small oligomer extract, polyether sulfone (PES), polyether ether ketone (PEEK), or material whose majority is composed of Teflon-system resin for the refrigerant of the type R32, R134 system, R125, R143 system, R152 system, hydrocarbon system and ammonium refrigerant. Moreover, to the above major components, there may be mixed any of a carbon fiber, glass fiber or molybdenum disulfide (MoS2), so that wear limit and lubricating ability are improved while the strength therefor is maintained.

Moreover, in the above material for the seal member 2035, there may be built therein material that presents a configuration-memorizing capability such that the height dimension becomes small in the event of high temperature. Thereby, the height is adjusted to the height of the step surface 2039 of the revolving spiral so as to be easily built in. Moreover, when the temperature rises up during the operation, the height is reduced. As a result thereof, adhesion with the revolving spiral 2015 is increased, thus improving sealing capability.

On the other hand, the main shaft 2029 that penetrates through the compression mechanism portion 205 is continuously integral with the main shaft 7 of the drive motor 203, and the both ends of the main shaft 2029 are freely rotatably supported by the secondary bearing 2057 of the support frame 2055 fixed and supported in the inner wall of the sealed casing 201.

In the main shaft 2029, there is provided the eccentric shaft portion 2059 that is eccentric to a central shaft center Y by a predetermined quantity e. In the eccentric shaft portion 2059, the bearing portion 2061 of the revolving spiral 2015 is freely rotatably inserted. From the bearing portion 2061 of the revolving spiral 2015 as a starting point, the lubricating oil is supplied via the lubricating passage 2065 to the main shaft 2053 and the secondary bearing 2057 by the oil pump 2063 provided in an lower portion of the main shaft 2029.

In the back-face side of the revolving spiral 2015 and between the support frame 2055, there are provided a rotation prevention mechanism 2067 such as an Oldham ring and the thrust ring 2069, respectively.

The rotation prevention mechanism 2067 functions to suppress the rotation of the revolving spiral 2015 at the time of rotation of the eccentric shaft portion 2059, so that the revolving motion is transmitted to the revolving spiral 2015.

The thrust ring 2069 functions as a means to partition so that the discharge gas and the suction gas are taken in at an inner side and an outer side, respectively via the gas passage 2071, and that a thrust force acting on the revolving spiral 2015 is balanced to have an optimal value.

In the fluid machine thus configured as above, the working gas taken in from the suction port 2027 rises up from the outer circumference to the center by means of the revolving motion of the revolving spiral 2015 and is compressed by the compressor space 2025 in which the volume thereof is decreased gradually. Then, after the compressed gas is discharged from the discharge port 2031 into the sealed casing 201, it is sent out externally from the discharge pipe 2029. During this operation, the inner engagement surface 2023 of the revolving spiral 2015 is engaged with the outer engagement surface 2017 of the fixed spiral 2013, so that the accuracy check for the engagement surface is necessary only for two sides and that the compression volume of the compressor space 2025 is determined by radial and height directions. As a result thereof, there can be obtained a significantly large compression volume without making entire machine large-sized.

Figure 27:
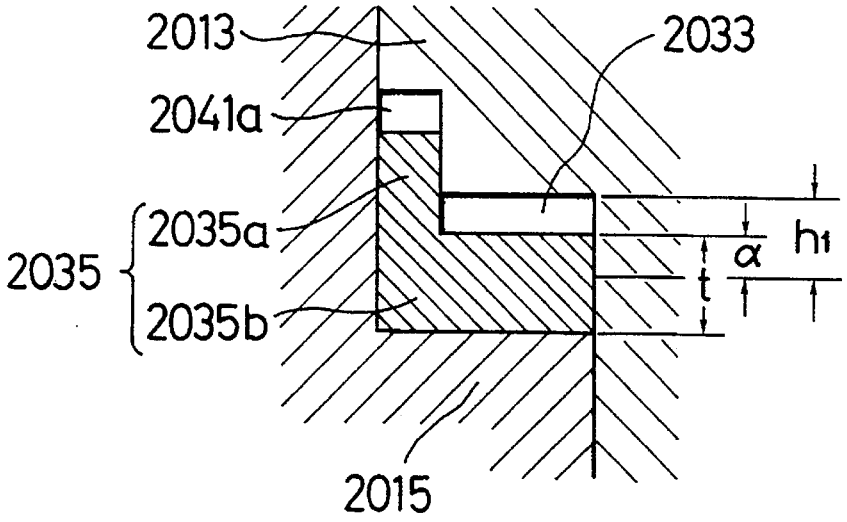
FIG. 27 is an enlarged view showing a portion indicated by X in FIG. 26.

On the other hand, the closed space 2033 that may be a cause of seal leakage is separated into two parts. In particular, the inner side, which is at a high-pressure side and may lead to gas leakage, will be occupied with a small space 2041*a* formed in an upper portion of the vertical portion 2041 as shown in FIG. 27, so that the gas leakage can be suppressed to the minimum, thus realizing efficient compression capability.

Figure 28:
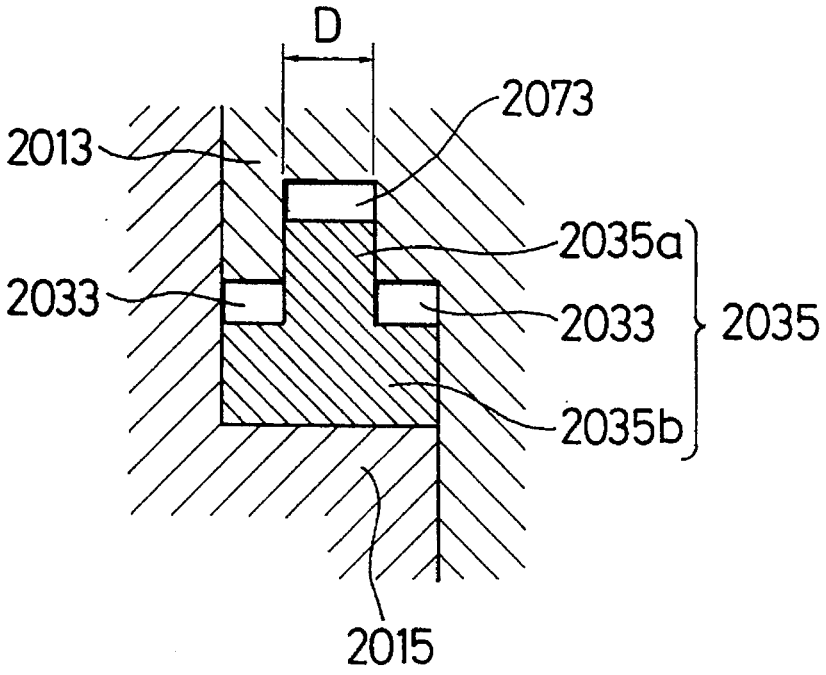
FIG. 28 is an enlarged view showing a modified example for a sub-seal portion, in a same manner as in FIG. 27.

FIG. 28 illustrates still another embodiment where the closed space 2033 is partitioned into a plurality of parts in the radial direction of the spiral.

In this embodiment, there is provided a seal holding ditch 2073 approximately in the center of the step surface 2037 at the side of the fixed spiral 2013, while approximately in the center of the seal portion main body 2035*b* of the seal member 2035 there is integrally provided the sub-seal portion 2035*a* facing the seal holding ditch 2073, so that the closed space 2033 is partitioned into a plurality of parts and that the inner closed space 2033 is made smaller.

According to this embodiment, in addition to the effect that the inner closed space 2033, which may lead to the gas leakage, is made small and longer width D of the sub-seal portion 2035 is ensured, so that the sub-seal portion 2035*a* functions as a reinforcing member and the strength for the entire seal member 2035 can be significantly improved. Moreover, the step surface 2039 of the revolving spiral 2015 is engaged only with the seal portion main body 2035*b* of the seal member 2035 so that if considered in terms of the friction it suffices to consider matching between material of the revolving spiral 2015 and the seal member 2035. Thereby, the material can be selected from wider ranges and the degree of freedom for designing is increased.

Figure 29:
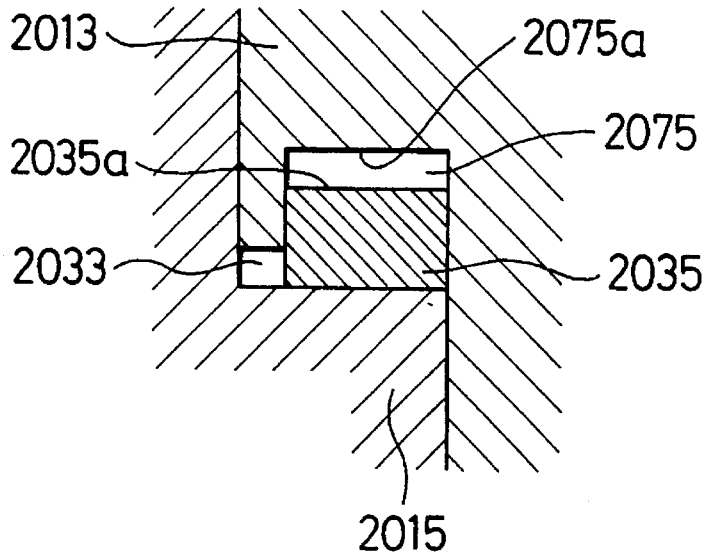
FIG. 29 shows an enlarged view where the seal member is provided in a seal support ditch provided in the step surface at the fixed spiral side, in a similar manner as in FIG. 27.

FIG. 29 illustrates still another embodiment where the inner closed space 2033, which may cause the gas leakage, is made small.

In this embodiment, there is provided a seal holding ditch 2075 with a predetermined width in the step surface 2037 at the side of the fixed spiral 2013, and the seal member 2035 borders within the seal holding ditch 2075. Thereby, the inside that may cause the gas leakage and the closed space 2033, shown in the left side in the figure, is made small. Moreover, the seal upper surface 2035*c* of the seal member 2035 and the ditch surface 2075*a* of the seal holding ditch 2075 are of the horizontally same surface shape so that they are almost in contact with each other.

According to this embodiment, the seal member 2035 moves in the up-down directions responsive to the revolving motion of the revolving spiral 2015, and the seal leakage can be suppressed maximally thanks to the small closed space 2033, thus realizing efficient compression capability. Moreover, since a cross sectional shape of the seal member 2035 is a simple rectangle, the processing therefor is easy, thus being advantageous in terms of cost performance.

Figure 30:
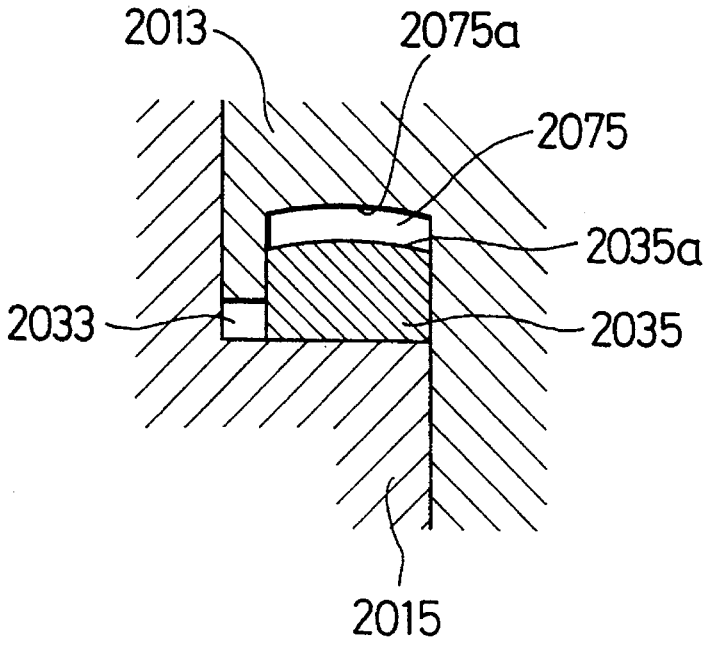
FIG. 30 shows an enlarged view where the upper surface of the seal in the seal member is made to the same shape with the arc-shape cutting work surface formed after a ditch surface of the seal support ditch is cutting-processed, in a similar manner as in FIG. 29.

The seal upper surface 2035*c* of the seal member 2035 as shown in FIG. 30 may be of a same contactable contact surface shape with arc cutting-processing surface obtained when the ditch surface 2075*a* of the seal holding ditch 2075 is cutting-processed by an end mill.

Figure 31:
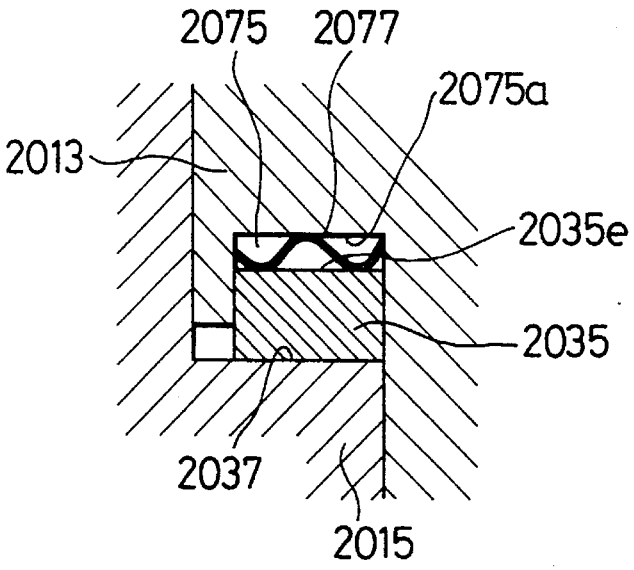
FIG. 31 shows an enlarged view where an energization spring is provided in the seal support ditch, in a similar manner as in FIG. 29.

Referring to FIG. 31, an energization spring 2077 may be provided between the ditch surface 2075*a* of the seal holding ditch 2075 and the seal upper surface 2035*c* of the seal member 2035, so that a contact surface pressure between the step surface 2037 of the revolving spiral 2015 and the seal member 2035*b* so as to improve seal capability.

Figure 32A:
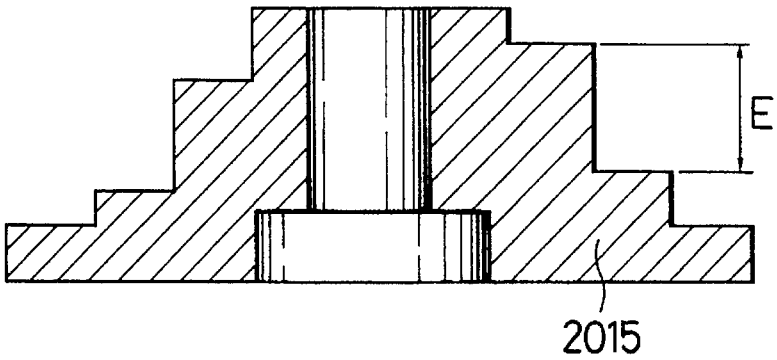
FIG. 32A and FIG. 32B illustrate and explain that height dimension of the seal member is made less than that of a step portion of the revolving spiral so as to achieve an improvement of assemblage.
Figure 32B:
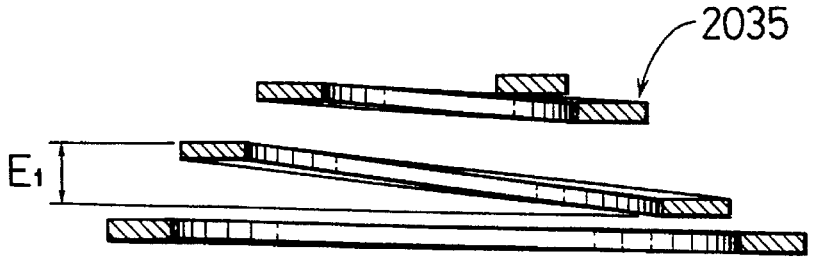

Referring to FIG. 32A and FIG. 32B, the height dimension E1 of the seal member 2035 can be processed in advance such that E1 is smaller than height dimension E of the step portion in the revolving spiral 2015 in a state where the seal member 2035 is removed. Thereby, the seal member 2035 can be in close contact with the step surface 2037 of the revolving spiral 2015 at the time of assemblage, thus improving the seal capability.

Figure 33:
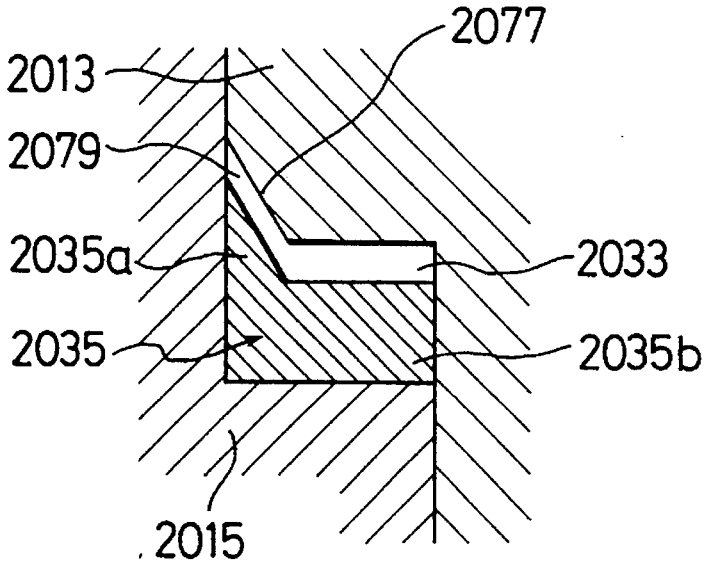
FIG. 33 shows an enlarged view where an increase of the seal area is intended by the sub-seal portion of the seal member and an area for use with a gas immersion is made small, in a similar manner as in FIG. 27.

FIG. 33 illustrates still another embodiment by which the invasion area where the gas enters in the closed space 2033 is made small, so that the entrance of gas into the closed space 2033 is prevented.

In other words, inside the step surface 2037 of the fixed spiral 2013 there is provided a slope surface 2077 extended upwardly, while the sub-seal portion 2035*a* rises up from the seal portion main body 2035*b* of the seal member 2035 along with the slope surface 2077. Therefore, the seal area of a high-pressure side which will be a side of seal leakage, is enlarged by the sub-seal portion 2035*a*, so that area 2079 for use with gas entrance connected to the closed space 2033 is of a shape made small.

Thereby, according to this embodiment, the gas-entering area 2079 is suppressed to its minimum, so that the invasion of the gas is prevented so as to achieve efficient compression state.

Figure 34:
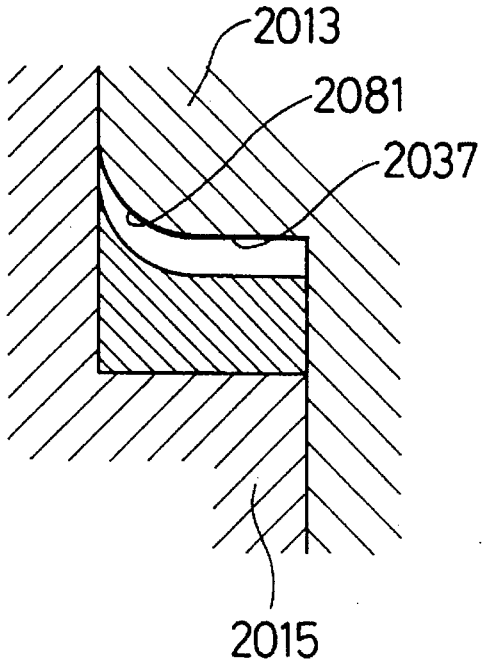
FIG. 34 shows an enlarged view in order to explain a second modified example of the sub-seal portion, in a similar manner as in FIG. 33.
Figure 35:
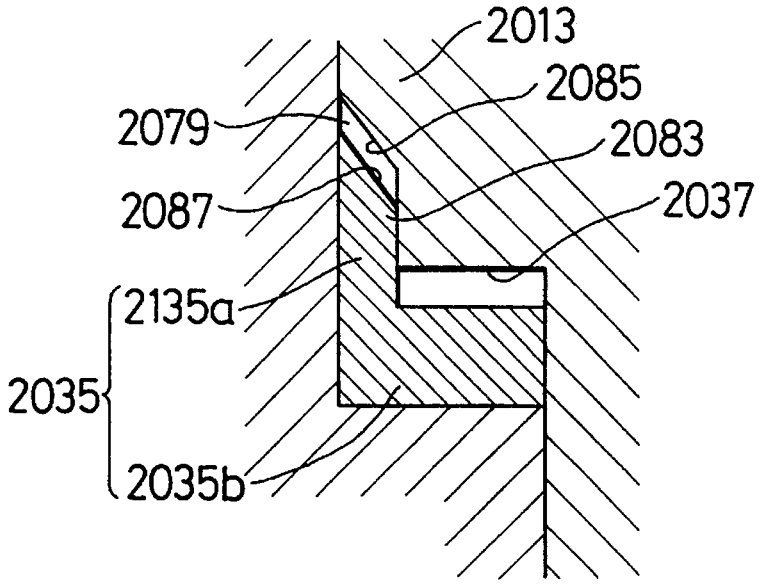
FIG. 35 shows an enlarged view in order to explain a third modified example of the sub-seal portion, in a similar manner as in FIG. 33.
Figure 36:
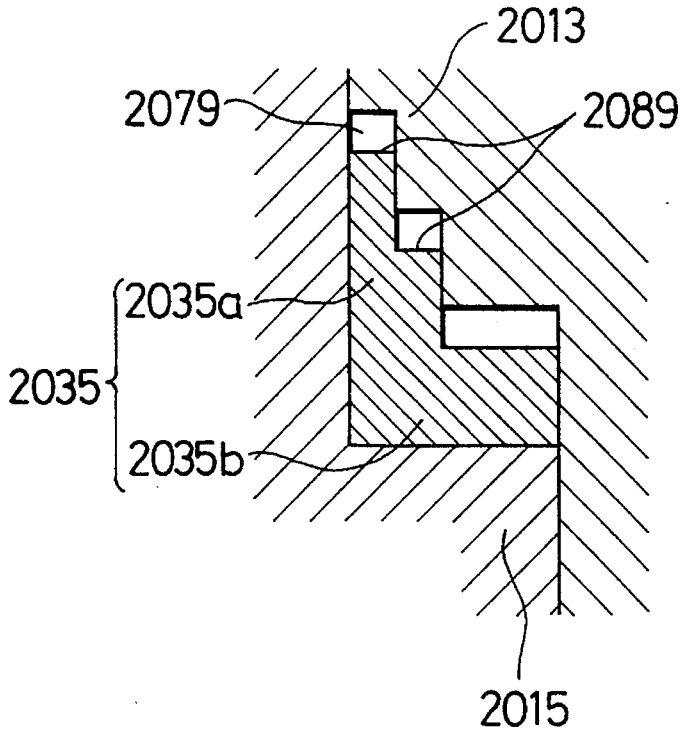
FIG. 36 shows an enlarged view in order to explain a fourth modified example of the sub-seal portion, in a similar manner as in FIG. 33.

FIG. 34–FIG. 36 show modified examples over FIG. 33 in which the invasion of the gas is prevented. In the embodiment shown in FIG. 34, the inside of the step surface 2037 in the fixed spiral 2013 is of a curved shape 2081 upwardly. While the sub-seal portion 2035 rises up integrally along with the curved shape 2081 from the seal portion main body 2035*b* of the seal member 2035. Thereby, the seal area due to the sub-seal portion 2035*a* is enlarged, so that the gas invasion can be suppressed to its minimum by a small gas-entering area 2079.

In the embodiment shown in FIG. 35, in the inside of the step surface 2037 in the fixed spiral 2013 there is provided a vertical portion 2083 and a ceiling surface of the vertical portion 2083 is made to a slope surface 2085 upwardly. At the same time, the sub-seal portion 2035*a* which is engaged with the vertical portion 2083 rises up from the seal portion main body 2035*b* of the seal member 2035, and the upper surface of the sub-seal portion 2035*a* is made to a slope surface 2087 counter to the slope surface 2085 of the vertical portion 2083.

Thereby, the seal area by the sub-seal portion 2035*a* is increased and a shape thereof is made so that the gas invasion can be suppressed to its minimum by the gas-entering area 2079.

In the embodiment shown in FIG. 36, inside the step surface 2037 of the fixed spiral 2013 there is formed a step-formed vertical portion 2089, while a plurality of step-formed sub-seal portions 2035*a* responsive to the step-formed vertical portions 2089 rise up from the seal portion main body 2035*b* of the seal member 2035.

Thereby, the seal area due to the sub-seal portion 2035*a* is increased and so configured that the gas invasion is suppressed to its minimum by the small gas-entering area 2079.

In each embodiment shown in FIG. 1–FIG. 36, though the relation of the revolving spiral responsive to the fixed spiral has been described, the configuration may be such that the first spiral is made to revolve relative to the second spiral, without explicitly defining the concept in terms of fixed or revolving rotation.

Moreover, though the compressor is took up for describing the fluid machine according to the present invention in each embodiment shown in FIG. 1–FIG. 36, the present invention is not limited to this use, and it is also utilized to the expansion machine and pump, with regard to basic construction.

In summary, by employing the fluid machine according to the present invention, the following advantageous effects are obtained:

(1) By varying a spiral pitch of the involute spiral, Archimedes spiral and logarithmic spiral and so on, the compression process and expansion process of the fluid working space can be freely designed in three dimensional directions (in the planar direction and height directions).

(2) It is very desirable in terms of processing, since precision check is only necessary for the inner engagement surface in the revolving spiral side and the outer engagement surface of the fixed spiral side.

(3) There can be obtained a desirable cooling state of the working mechanism portion (for example, a compression mechanism portion in the case of the compressor) as a fluid working mechanism portion.

(4) The revolving spiral can have configuration where the revolving spiral is supported at its upper and lower portions, so that an unstable operation of the revolving spiral can be prevented. Thereby, the mechanical loss can be reduced, and high compressibility and expansion coefficient can be obtained, and the noise can be suppressed.

(5) The closed space between the working spaces (for example, a space between the compressor spaces in the case of the compressor) is partitioned into small spaces by the seal member, so that the seal leakage can be suppressed maximally even in the event that there occurs the seal leakage, thus realizing efficient compression and expansion.

Besides those already mentioned above, many modifications and variations of the above embodiments may be made without departing from the novel and advantageous features of the present invention. Accordingly, all such modifications and variations are intended to be included within the scope of the appended claims.

What is claimed is:

1. A fluid machine for transferring working fluid, comprising:

a first spiral member having a stepped spiral inner engagement surface spirally rising up from an outer circumference toward a center;

a second spiral member having a stepped spiral outer engagement surface, wherein one of the first and second spiral members is rotatable relative to the other of the first and second spiral members, and wherein the outer engagement surface of the second spiral member is received in a space defined by the inner engagement surface of the first spiral member; and a sealed working space formed between the inner engagement surface of the first spiral member and the outer engagement surface of the second spiral member, wherein a capacity of the sealed working space gradually decreases toward the center from the outer circumference.

2. The machine of claim 1, wherein the second spiral member is rotatable relative to the first spiral member and includes a plurality of eccentric sliding portions that contact the first spiral members, so as to form a plurality of 360-degree working spaces in the three dimensional directions.

3. The machine of claim 1, wherein the spiral engagement surfaces of the first and second spiral members has a shape of at least one closed curve selected from involute, Archimedes and logarithmic curves.

4. The machine of claim 3, wherein the shapes for the first spiral and second spiral members are ones whose spiral's axial direction height increases at a certain rate toward a direction in which the spiral' radius becomes smaller.

5. The machine of claim 3, wherein the radial height of the stepped spiral surface of the first spiral member is constant on the radius from the spiral's center or a tangent line of a basic circle of the spiral.

6. The machine of claim 3, wherein the shapes for the first spiral and second spiral members are such that there is a step difference between the spiral members so that the axial height of the spiral increases in a step-formed way and that the spiral's axial height of the first and second spiral members is continuously increased toward the center from the outer circumference.

7. The machine of claim 3, wherein the height of the first spiral and second spiral members is varied according to the position of the spiral.

8. A fluid machine for transferring working fluid, comprising:

a first spiral member having a stepped spiral inner engagement surface spirally rising up from an outer circumference toward a center;

a second spiral member having a stepped spiral outer engagement surface, wherein one of the first and second spiral members is rotatable relative to the other of the first and second spiral members, and wherein the outer engagement surface of the second spiral member is received in a space defined by the inner engagement surface of the first spiral member;

a working space formed between the inner engagement surface of the first spiral member and the outer engagement surface of the second spiral member, wherein a capacity of the working space gradually decreases toward the center from the outer circumference, and a seal member between the stepped engagement surfaces of the first and second spiral members to seal the working space.

9. The machine of claim 8, further comprising a sealed case encasing the first and second spiral members and wherein an inner space of the sealed case is filled with gas of working fluid.

10. A fluid machine for transferring working fluid, comprising:

a revolving spiral member having a stepped spiral outer engagement surface spirally rising up from an outer circumference toward a center;

a fixed spiral member having a stepped spiral inner engagement surface, wherein the outer engagement surface of the revolving spiral member is received in a space defined by the inner engagement surface of the fixed spiral member;

a working space formed between the inner engagement surface of the fixed spiral member and the outer engagement surface of the revolving spiral member, wherein a capacity of the working space gradually decreases toward the center from the outer circumference; and a seal member provided between the stepped engagement surfaces of the revolving and the fixed spiral members to seal the working space.

11. The machine of claim 10, wherein the revolving spiral member includes a plurality of eccentric sliding portions that contact the fixed spiral, so as to form a plurality of 360-degree working spaces in three dimensional directions.

12. A fluid machine for transferring working fluid, comprising:

a revolving spiral member having a stepped spiral outer engagement surface spirally rising up from an outer circumference toward a center;

a fixed spiral member having a stepped spiral inner engagement surface, wherein the outer engagement surface of the revolving spiral member is received in a space defined by the inner engagement surface of the fixed spiral member;

a sealed working space formed between the inner engagement surface of the fixed spiral member and the outer engagement surface of the revolving spiral member, wherein a capacity of the sealed working space gradually decreases toward the center from the outer circumference;

a main shaft for rotating the revolving spiral member and a rotation-preventing mechanism for preventing relative rotation between the main shaft and the revolving spiral member; and a drive motor connected to the main shaft to produce rotation power to the main shaft.

13. The machine of claim 12, wherein the revolving and fixed spiral members are disposed below the drive motor.

14. The machine of claim 12, wherein the revolving and fixed spiral members are disposed above the drive motor.

15. A fluid machine for transferring working fluid, comprising:

a first spiral member having a stepped spiral outer engagement surface spirally rising up from an outer circumference toward a center;

a second spiral member having a stepped spiral inner engagement surface, wherein the outer engagement surface of the revolving spiral member is received in a space defined by the inner engagement surface of the fixed spiral member;

a main shaft inserted through the first spiral member and having an eccentric shaft portion, wherein the first spiral and the second spiral members are combined so that the inner engagement surface of the first spiral member contacts the outer engagement surface of the second spiral member, wherein an axial center of the first spiral member is offset against an axial center of the second spiral member so that a plurality of 360-degree working spaces are formed between the engagement surfaces of the first and second spiral members, wherein a capacity of the working space is decreased in the axial direction; and an Oldham mechanism portion for preventing the rotation of the second spiral member, which eccentrically rotates, due to the rotation of the main shaft against the second spiral member, and which energizes a revolving motion to the second spiral member.

16. The machine of claim 15, wherein the main shaft penetrates through the second spiral member and there is provided a main bearing surface in a penetrating wall surface of the second spiral member.

17. The machine of claim 15, wherein the main shaft penetrates through the second spiral member and there is provided a first main bearing surface in a penetrating wall surface of the second spiral member and further wherein there is provided a second main bearing that receives the main shaft via the first spiral member.

18. The machine of claim 17, wherein at least the first main bearing surface extends to a side of the eccentric shaft portion.

19. The machine of claim 15, wherein a sliding portion with the first spiral member in the eccentric shaft portion of the main shaft is provided within a working gas load activating area that acts upon the second spiral member.

20. The machine of claim 19, wherein an axially extending central portion of the sliding portion in the first spiral member and in the eccentric shaft portion of the main shaft coincides with a load point of working gas that acts upon the second spiral member.

21. A fluid machine for transferring working fluid, comprising:

a first spiral member having a stepped spiral inner engagement surface spirally rising up from an outer circumference toward a center;

a second spiral member having a stepped spiral outer engagement surface, wherein one of the first and second spiral members is rotatable relative to the other of the first and second spiral members, and wherein the outer engagement surface of the second spiral member is received in a space defined by the inner engagement surface of the first spiral member;

a working space formed between the inner engagement surface of the first spiral member and the outer engagement surface of the second spiral member, wherein a capacity of the working space gradually decreases toward the center from the outer circumference, wherein the working space is spiral and is continuously closed between a step surface of the inner engagement surface at a side of the first spiral member and a step surface of the outer engagement surface at a side of the second spiral member; and a seal member in the closed working space, and the thickness of the seal member is made greater than a high-low variable width of the spirals formed by the revolving motion of one of the first and second spiral members.

22. A fluid machine for transferring working fluid, comprising:

a first spiral member having a stepped spiral inner engagement surface spirally rising up from an outer circumference toward a center;

a second spiral member having a stepped spiral outer engagement surface, wherein one of the first and second spiral members is rotatable relative to the other of the first and second spiral members, and wherein the outer engagement surface of the second spiral member is received in a space defined by the inner engagement surface of the first spiral member;

a working space formed between the inner engagement surface of the first spiral member and the outer engagement surface of the second spiral member, wherein a capacity of the working space gradually decreases toward the center from the outer circumference; and a seal member which is provided in a spiral closed space formed between a step surface of the inner engagement surface at a side of first spiral member and a step surface of the other engagement surface at a side of the second spiral member, the spiral closed space forming the working space, wherein the seal member has a sub-seal portion integrally with the seal member, which reduces an invasion area through which gas enters to the closed space.

23. A fluid machine for transferring working fluid, comprising:

a first spiral member having a stepped spiral inner engagement surface spirally rising up from an outer circumference toward a center;

a second spiral member having a stepped spiral outer engagement surface, wherein one of the first and second spiral members is rotatable relative to the other of the first and second spiral members, and wherein the outer engagement surface of the second spiral member is received in a space defined by the inner engagement surface of the first spiral member;

a working space formed between the inner engagement surface of the first spiral member and the outer engagement surface of the second spiral member, wherein a capacity of the working space gradually decreases toward the center from the outer circumference; and a seal member for partitioning the working space into small spiral closed spaces, the spiral closed spaces being formed between a step surface of the inner engagement surface at a side of first spiral member and a step surface of the other engagement surface at a side of the second spiral member.

24. A fluid machine for transferring working fluid, comprising:

a first spiral member having a stepped spiral inner engagement surface spirally rising up from an outer circumference toward a center;

a second spiral member having a stepped spiral outer engagement surface, wherein the second spiral members is rotatable relative to the first spiral member, and wherein the outer engagement surface of the second spiral member is received in a space defined by the inner engagement surface of the first spiral member;

a working space formed between the inner engagement surface of the first spiral member and the outer engagement surface of the second spiral member, wherein a capacity of the working space gradually decreases toward the center from the outer circumference;

a seal support ditch provided at a side of the stepped engagement surface of the first spiral member, wherein a spiral-shaped continuous closed space is formed between a step surface of the inner engagement surface at a side of the first spiral member and a step surface at a side of the first spiral member and a step surface of the outer engagement surface at a side of the second spiral member, the working space being formed in the closed space; and a seal member provided in the seal support ditch to partition the closed space into small closed spaces, wherein the upper surface of the seal member and the ditch surface of the seal support ditch disposed counter to the seal upper surface are of the identical contact-surface shape so as to be capable of being contacted to each other.

25. The machine of claim 24, wherein the upper surface of the seal member has an identical shape as the seal support ditch.

26. The machine of claim 24, wherein the seal member is spiral and there is a step difference between a fixed spiral member in close proximity of at least one of winding-start portion of winding-end portion of the seal member.

27. The machine of claim 24, wherein the length along with the spiral of a step difference portion provided in the first spiral member is longer than that of the seal member.

* * * * *